US006212350B1

(12) United States Patent
Yamada et al.

(10) Patent No.: US 6,212,350 B1
(45) Date of Patent: Apr. 3, 2001

(54) FORMATION METHOD, IMAGE FORMATION SYSTEM, AND INTERMEDIATE TRANSFER BODY HAVING A PHOTOCONDUCTIVE RESISTIVITY CHANGE LAYER

(75) Inventors: Taichi Yamada; Yoshinari Ueno; Satoshi Shigezaki; Hideyuki Akagi; Susumu Hiranuma, all of Minami Ashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 09/291,934

(22) Filed: Apr. 15, 1999

(30) Foreign Application Priority Data

Apr. 17, 1998 (JP) ..... 10-123999

(51) Int. Cl.[7] ..... G03G 15/16; G03G 15/01
(52) U.S. Cl. ..... 399/302; 399/66
(58) Field of Search ..... 399/66, 297, 302, 399/308, 128; 430/126

(56) References Cited

U.S. PATENT DOCUMENTS 4,592,643 * 6/1986 Higashiguchi et al. ..... 399/128
5,361,125 * 11/1994 Fletcher ..... 399/302
5,946,538 * 8/1999 Takeuchi et al. ..... 399/302

FOREIGN PATENT DOCUMENTS 4-168464 * 10/1990 (JP) .
5-257398 10/1993 (JP) .
6-282181 10/1994 (JP) .
7-146616 6/1995 (JP) .
8-248779 9/1996 (JP) .
8-320622 12/1996 (JP) .

* cited by examiner

*Primary Examiner*—Arthur T. Grimley
*Assistant Examiner*—Hoang Ngo
(74) *Attorney, Agent, or Firm*—Oliff & Berridge, PLC

(57) ABSTRACT

An image formation system where, when an intermediate transfer body B having a resistivity change layer B2 whose volume resistivity lowers in a state in which predetermined physical stimulation (light application, etc.,) passes through an electricity removal area Q5 after secondary transfer is executed, physical stimulation is given to the intermediate transfer body B for lowering the volume resistivity of the intermediate transfer body B and in this state, electricity of the intermediate transfer body B is removed.

22 Claims, 15 Drawing Sheets

B1: BASE MATERIAL
B2: PHOTOCONDUCTIVE LAYER
B2a: BLOCKING LAYER
B2b: CHARGE GENERATION LAYER
B2c: CHARGE TRANSPORT LAYER

MEASUREMENT CONDITIONS

| ENVIRONMENT | 22° C x 55%RH |
|---|---|
| PAPER | OHP (A4) |
| INNER SECONDARY TRANSFER ROLL SURFACE RESISTIVITY | $1 \times 10^7\ \Omega/\square$ |
| OUTER SECONDARY TRANSFER ROLL VOLUME RESISTIVITY | $1 \times 10^9\ \Omega \cdot cm$ |

TABLE 1

| DISTANCE FROM SECOND BTR END | DISTANCE FROM OHP END | IBT IN RELATED ART ($\rho=10^{25}\Omega\cdot cm$) | | IBT OF FIRST EXAMPLE ($\rho>10^{15}\Omega\cdot cm$) | | |
|---|---|---|---|---|---|---|
| | | V2nd:-1500V | V2nd:-2500V | V2nd:-1000V | V2nd:-1500V | V2nd:-2000V |
| 50mm | 10mm | −150 | −570 | −500 | −775 | −1050 |
| 156mm | 116mm | −575 | −1200 | −430 | −700 | −1025 |

Fig. 6

CHARGE BEHAVIOR OF PHOTOCONDUCTIVE INTERMEDIATE TRANSFER BODY OF FIRST EXAMPLE

| | | INTERMEDIATE TRANSFER BODY CHARGE POTENTIAL (V) | | | |
|---|---|---|---|---|---|
| | | V2nd:-500V | V2nd:-1000V | V2nd:-1500V | V2nd:-1500V |
| (T=0) | 0 | 0 | 0 | 0 | 0 |
| (AFTER 1 CYCLE OF 1st TRANSFER) | 1 | −125 | −125 | −125 | −125 |
| (AFTER 2 CYCLES OF 1st TRANSFER) | 2 | −300 | −300 | −300 | −300 |
| (AFTER 3 CYCLES OF 1st TRANSFER) | 3 | −450 | −450 | −450 | −450 |
| (AFTER 4 CYCLES OF 1st TRANSFER) | 4 | −625 | −625 | −625 | −625 |
| (AFTER 2nd TRANSFER) | 5 | −375 | −100 | 25 | 30 |
| (AFTER ELECTRICITY REMOVAL) | 6 | 0 | 0 | 25 | 30 |

Fig. 8

WHEN NO PRECHARGES EXIST

WHEN NO PRECHARGES EXIST

WHEN PRECHARGES EXIST

WHEN PRECHARGES EXIST

FORMATION METHOD, IMAGE FORMATION SYSTEM, AND INTERMEDIATE TRANSFER BODY HAVING A PHOTOCONDUCTIVE RESISTIVITY CHANGE LAYER

BACKGROUND OF THE INVENTION

This invention relates to an image formation system using an electrophotographic technology, such as a copier, facsimile, or a printer, and more particularly to an image formation system using an intermediate transfer technique involving primary and secondary transfer steps with an intermediate transfer body, etc., intervening and an intermediate transfer body used with the image formation system.

A method of once primarily transferring a toner image (developed image) formed on an image support such as a photosensitive drum onto an intermediate transfer body other than transfer paper and then secondarily transferring the image onto transfer paper for providing a copy image is known as an image formation method (transfer method) in a color image formation system such as an electrophotographic copier.

It is known that this method can be used to suppress occurrence of a multiple transfer failure and a color registration shift caused by many factors of a transfer paper hold state, transfer paper thickness or firmness, a transfer paper surface property, etc.

FIG. 10 is a schematic representation of an image formation system in a related art using an intermediate transfer body incorporating the Invention.

In the figure, an image formation system F has a UI (user interface) and a transparent platen glass 2 on which an original (not shown) is placed.

The original placed on the platen glass 2 is illuminated by a light source 4 of an original light unit 3. Original-reflected light is reflected on a first mirror 5 of the original light unit 3 and a second mirror 7 and a third mirror 8 of a mirror unit 6, passes through an image formation lens 9, and is read as analog signals of R, G, and B by a CCD (charge-coupled device).

The image signals read by the CCD are input to an IPS controlled by a controller C. Image read data output means 11 of the IPS converts the input read image signals from analog form into digital form. Image data output means 12, which has an image memory 13, converts the digital data provided by the image read data output means 11 into Y, M, C, X image data, performs data processing of density correction, scaling correction, etc., and outputs the resultant data as write image data (laser drive data).

A laser drive signal output unit 14 outputs a laser drive signal of an image responsive to the image data output from the IPS to an ROS (optical scanner, namely, a latent image formation unit) at a predetermined timing. The ROS outputs a laser beam L modulated by the laser drive signal.

An image support 16 which rotates in charged by a charger 17, then an electrostatic latent image is written onto the image support 16 at a latent image write position Q1 by the laser bean L and the electrostatic latent image is developed to a toner image by a rotary developing unit 18 having K (black), Y (yellow), M (magenta), and C (cyan) color developing devices 18*k*, 18*y*, 18*m*, and 18*c* rotating together with a rotation shaft 18*a* in a developing area Q2. The developed toner image is primarily transferred to an intermediate transfer belt B by means of a primary transfer roll (primary transfer device) in a primary transfer area Q3.

Residual toner on the surface of the image support 16 passing through the primary transfer area Q3 is removed by an image support cleaner 20.

The intermediate transfer belt B is supported by belt support rolls 26–29 of a drive roll 26, a tension roll 27, an idler roll 28, and an inner secondary transfer roll (backup roll) 29 for rotation.

A secondary transfer device T2 is made up of the inner secondary transfer roll 29, an outer secondary transfer roll 30 placed between a distant position from the inner secondary transfer roll 29 and a near position at which the outer secondary transfer roll 30 is pressed against the inner secondary transfer roll 29 so that the outer secondary transfer roll 30 can be moved away from and toward the inner secondary transfer roll 29, and an electrode roll 31 coming in contact with the inner secondary transfer roll 29. The secondary transfer device T2 is driven by a power supply circuit 32 controlled by the controller C.

The secondary transfer device T2 secondarily transfers the toner images primarily transferred onto the intermediate transfer belt B in overlapped relation to a transfer material S passing through a secondary transfer area Q4 formed in a nip (contact area) between the outer secondary transfer roll 30 and the intermediate transfer belt B.

Toner deposited on the surface of the outer secondary transfer roll 30 is removed by a secondary transfer roll cleaner 33. A belt cleaner 34 in placed downstream from the secondary transfer area Q4 along the surface of the intermediate transfer belt B.

A belt position sensor SN1 is provided for detecting a position detection mark (not shown) to detect a rotation position of the intermediate transfer belt B. The latent image write timing onto the image support 16 is controlled by a position detection signal of the intermediate transfer belt B with very high accuracy output from the belt position sensor SN1.

The transfer material S stored in a paper feed tray 41 is taken out by a pickup roll 42, is separated one sheet at a time by a handling roller 43, is once stopped at a registration roll 44, and is transported from a guide transport passage 45 to the secondary transfer area Q4 at a predetermined timing. The transfer material S to which the toner image is secondarily transferred when the transfer material S passed through the secondary transfer area Q4 is transported through a sheet guide 46 and on a sheet transfer belt 47 to a fixing area Q6. When the transfer material S passes through the fixing area Q6, the secondarily transferred toner image onto the transfer material S is fixed by a pair of fixing roll a of a fuser 48 and the transfer material S is diacharged to a paper discharge tray 49.

The components 41 to 47 make up a transfer material transporter (42–47).

The image formation system incorporating the invention shown in FIG. 10 uses the intermediate transfer belt B as an intermediate transfer body, but the invention can also be applied to an image formation system using an intermediate transfer drum in place of the intermediate transfer belt B.

In the image formation system using an intermediate transfer body as described above, hitherto a substance comprising a filler such as carbon or a metal compound dispersed in a polymeric material as a conductive agent has been used an the intermediate transfer body. (The Unexamined Japanese Patent Application Publication No. Hei 8-320622).

It is known that there is a close relation between the volume resistivity of the intermediate tranafer body and the toner image quality.

(When Volume Resistivity of Intermediate Transfer Body, ρ, is low)

When the volume resistivity of the intermediate transfer body, ρ, is too low ($\rho \leqq 10^6$ Ωcm), toner strikingly scatters at the transfer time and the image quality is degraded (The Unexamined Japanese Patent Application Publication No. Hei 8-248779). The possible reason is that when the volume resistivity of the intermediate transfer body is too low, a transfer electric field is easily applied to an area with no toner layer by the action of transfer current and transfer electric field produced by a primary transfer roll and thus a transfer area spreads and toner scatters and is transferred because of the effect.

(When Volume Resistivity of Intermediate Transfer Body is Intermediate)

The current intermediate transfer body of the image formation system in the actual use has an intermediate value of volume resistivity ($10^6$ Ωcm$\leqq\rho\leqq 10^{14}$ Ωcm).

Such an image formation system has charges attenuated properly because of the semiconductivity of the intermediate transfer body. That is, an average value of the volume resistivity of the intermediate transfer body lies in the range in which the charges are attenuated properly (the volume resistivity is in a proper range), thus consecutive image formation can be executed without using an electricity removal member.

However, if the average value of the volume resistivity of the intermediate transfer body lies in the proper range (the range in which the charges are attenuated properly), the intermediate transfer body in related art causes the following problems:

If a filler such as carbon or a metal compound is dispersed in a polymeric resin, resistance variations in the intermediate transfer body caused by the dispersion state of the filler are an order of magnitude larger, low resistance of the intermediate transfer body caused by electric breakdown of a minute polymeric resin part between fillers, filler re-arrangement caused by energization, and the like occur with time. Thus, when printout is produced, the volume resistivity of the intermediate transfer body is placed out of a good volume resistivity range partially or on a whole with time, degrading the image quality.

(When Volume Resistivity of Intermediate Transfer Body, ρ, is High)

When the volume resistivity of the intermediate transfer body, ρ, is high ($\rho>10^{14}$ Ωcm), the charge retainability of the intermediate transfer body in a toner image area is enhanced and an electric field required for transfer can be applied to toner appropriately. On the other hand, charge move on the interediate transfer body surface of an adjacent non-image part and internal charge move decrease, thus toner transfer to the area in the primary transfer and secondary transfer becomes hard to occur.

Thus, when the volume resistivity of the intermediate transfer body is high, toner less scatters and a good-quality toner formation image can be provided. In this case, however, a step of removing charges accumulated on the intermediate transfer body becomes necessary after toner transfer, and it is difficult to uniformly remove the charges accumulated on the intermediate transfer body at the removal step, thus the art is not in the actual use. The reason why the art is not in the actual use is as follows:

To provide the charge (electricity) removal step, it is easily assumed that a corotron, an electricity removal roll, etc., is used as an electricity removal member.

To use an electricity removal roll as the electricity removal member to remove the charges (electricity) accumulated on the intermediate transfer body, an electricity removal roll with AC bias voltage applied may be used. In this case, since there are asperities, etc., on the intermediate transfer body surface and the electricity removal roll surface, the full surface of the intermediate transfer body which rotates cannot be brought into contact with the electricity removal roll grounded. Electricity on the intermediate transfer body portion not coming in contact with the electricity removal roll is hard to remove in a state in which the volume resistivity of the intermediate transfer body is high. That is, when the volume resistivity of the intermediate transfer body is high, it is difficult to reliably remove electricity on the full surface of the intermediate transfer body in a short time for which the intermediate transfer body passes through the electricity removal member. If uneven electricity removal occurs on the intermediate transfer body surface, inconsistencies in density responsive to the uneven electricity removal occur in a toner image primarily transferred to the intermediate transfer body surface at the next image formation time. Because of the electricity removal step of discharging, an expensive high-voltage power supply for electricity removal also becomes necessary.

To use a corotron to remove electricity, a large amount of ozone occurs, image quality defect based on uneven electricity removal caused by deposit on the corotron occurs, and a discharge product of NOx, O3, or any other ozone reaction product is deposited on the intermediate transfer body.

To use an intermediate transfer body of high resistivity with the volume resistivity ρ exceeding $10^{14}$ Ωcm as described above, an electricity removal member for removing electricity after the termination of secondary transfer becomes necessary. Particularly, the higher the value of ρ, the more difficult to uniformly remove electricity on the full surface of the intermediate transfer body if the electricity removal member is used.

Therefore, the intermediate transfer body having high volume resistivity is useful considering only the transfer effect, but requires an electricity remove step and it is hard to uniformly remove electricity on the intermediate transfer body. Thus, hitherto an image formation system using an intermediate transfer body having high resistivity (volume resistivity ρ is greater than $10^{14}$ Ωcm) has not yet been in the actual use.

Arts (J01) to (J03) described later are known as those using an intermediate transfer body with volume resistivity lowering if physical stimulation is given in conventional image formation systems. The reason why an intermediate transfer body whose resistance value lowers is used in (J01) to (J03) is that electricity on the intermediate transfer body to which primary transfer is executed by a special method is removed before secondary transfer in (J01) and that lowering the resistance value of the intermediate transfer body is used to execute secondary transfer in (J02) and (J03).

That is, (J01) to (J03) provide image formation systems each using an intermediate transfer body whose resistance value lowers to execute special transfer and are different arts from those of image formation systems for executing transfer by normal transfer electric field. That is, (J01) to (J03) are idea arts and are not in the actual use. Moreover, the following problems are involved:

(J01) Art described in the Unexamined Japanese Patent Application Publication No. Hei 7-146616 (see FIG. 11)

FIGS. 11A to 11F are schematic representations of an art described in the Unexamined Japanese Patent Application Publication No. Hei 7-146616.

In the figure, Q1 denotes a primary transfer area, Q2 denotes a secondary transfer area, and 01*a* and 01*b* (FIG.

11B) denote a conductive rubber layer 01*a* with carbon mixed and a silicone rubber layer 01*b* with a charge generation agent mixed as surface layers of a blanket 01 (FIG. 11A).

In FIG. 11C, the blanket 01 (intermediate transfer body) having photoconductivity is used as an intermediate transfer body and the surface of the blanket 01 is charged to polarity (+) opposite to charge polarity (–) of toner. In FIG. 11D, toner is primarily transferred from a photosensitive drum 02 to the intermediate transfer body blanket 01 by a static electricity force caused by the charge. In FIG. 11E, after the primary transfer and before secondary transfer, light L is applied to the intermediate transfer blanket 01 and the primarily transferred toner image on the surface of the blanket for removing electricity (see FIG. 12A). In FIG. 11F, the bonding force between the surface of the blanket 01 and the toner is weakened by removing electricity, thus secondary transfer is easily executed by application of light.

However, in the art, as shown in FIG. 12B, the surface of the blanket 01 is charged to the polarity opposite to the toner charge polarity on the photosensitive body 02 as a stage before primary transfer is executed from the photosensitive body 02 to the intermediate transfer blanket 01, thus toner transfer occurs in the area before the primary transfer area; degradation of image quality caused by image disorder, bleeding, etc., cannot be prevented.

FIGS. 12A to 12D are schematic representations of a problem arising when the art described in the Unexamined Japanese Patent Application Publication No. Hei 7-146616 (art (J01)) is applied to a multiple transfer system of color image in different color toners.

In FIG. 12, the first color toner is primarily transferred to the intermediate transfer blanket 01, then the first color toner on the blanket 01 is charged to the polarity opposite to the toner charge polarity on the photosensitive body 02 for primary transfer of the second color toner (FIG. 12C) and the toner on the photosensitive body 02 is transferred to the blanket 01. At this time, a sufficient transfer electric fluid to transfer the toner on the photosensitive body 02 is applied between the photosensitive body 02 and the blanket 01, so that the second color toner on the photosensitive body 02 is transferred to the blanket 01. Conversely, the first color toner of the opposite polarity on the blanket 01 is transferred to the photosensitive body 02 (FIG. 12D). Therefore, if the art described in (J01) is applied to the multiple transfer system of color image, it is very difficult to provide a good-quality color image by multiple transfer.

(J02) Art described in the Unexamined Japanese Patent Application Publication No. Hei 5-257398

FIGS. 13A to 13D are schematic representations of an art described in the Unexamined Japanese Patent Application Publication No. Hei 5-257398.

The Unexamined Japanese Patent Application Publication No. Hei 5-257398 proposes a method intended for preventing transfer in a before-transfer area in FIGS. 13A and 13B, the method of applying precharges of the same polarity as a toner charge polarity onto the surface of a photoconductive intermediate transfer body 01 by a before-transfer charger 03 before primary transfer is executed as shown in FIG. 13C and applying light from the rear face of the intermediate transfer body 01 in a primary transfer area Q1 for executing primary transfer as shown in FIG. 13D.

This method can reduce transfer in the before-transfer area, but can provide good transfer images of only single-color images and is hard to provide a clear full color image.

FIGS. 14A and 14B are schematic representations of a problem arising when a developed image of the second color is transferred by the art described in the Japanese Patent Application Publication No. Hei 5-257398.

In FIG. 14, precharges are given also including the toner image of the first color already transferred onto an intermediate transfer body 01 (FIG. 14A) and light is applied from the rear face in a primary transfer area Q1 for executing transfer (FIG. 14B). At this time, charges on the intermediate transfer body 01 are removed, but the toner charges of the first color are not removed. Resultantly, an electric field produced by the unremoved toner charges of the first color causes the second color toner to scatter and unevenness to occur.

(J03) Art described in the Unexamined Japanese Patent Application Publication No. Hei 6-282181

FIGS. 15A and 15B are schematic representations of an art using an intermediate transfer body whose resistance value lowers by light application and applying light for executing transfer, described In the Unexamined Japanese Patent Application Publication No. Hei 6-282101. FIGS. 16A and 162 are schematic representations of an art using an intermediate transfer body whose resistance value lowers by applying pressure and applying pressure for executing transfer, described in the Unexamined Japanese Patent Application Publication No. Hei 6-282181.

In FIG. 15, a transfer material 04 such as paper is electrostatically held on an intermediate transfer body 01, light is applied from the rear face of the intermediate transfer body 01 in a transfer area Q1, and a transfer electric field produced by holes generated in a charge generation layer 01*c* is applied for transferring a toner image on a photosensitive drum 02. In this method, the resistance of the intermediate transfer body 01 is lowered by the action of light, etc, in the transfer area Q1 and a transfer electric field is applied, thus resistance becomes low in the axial direction of the photosensitive drum 02 (in a direction perpendicular to the move direction of paper). Thus, it becomes hard to prevent scatter and bleeding of a toner image in the axial direction.

FIG. 16 shows an art of lowering resistance by applying pressure rather than light in FIG. 15 and executing transfer. The art shown in FIG. 16 also involves a similar problem to that of the art shown in FIG. 15. In addition, it is hard to applying uniform pressure to an intermediate transfer body because of bend of a shaft of an intermediate transfer body support roll, asperities on the surface, etc., and transfer unevenness is caused by pressure distribution unevenness.

SUMMARY OF THE INVENTION

It is therefore an object of the invention, in an image formation system comprising a primary transfer device for producing a primary transfer electric field for primarily transferring a toner image on an image support to an intermediate transfer body and a secondary transfer device for producing a secondary transfer electric field for secondarily transferring the toner image primarily transferred onto the intermediate transfer body to a transfer material, or the intermediate transfer body used with the image formation system, to make the following description (O01) possible:

(O01) to enable transfer with toner less scattering in a state in which the volume resistivity of the intermediate body is high when the transfer devices for producing transfer electric fields are used to execute the primary transfer and secondary transfer, and to facilitate removal of charges of the intermediate transfer body generated by the transfer electric fields.

The reference characters (numerals) enclosed in parentheses following the members of the invention in the description of the invention are those of the members of example described later to facilitate understanding of the correspondence between the members of the invention and those of the example. The invention will be discussed in correspondence with the reference characters (numerals) in the example described later to make easy understanding of the invention and not to limit the scope of the invention to the example.

(First Aspect of the Invention)

To the end, according to a first aspect of the invention, there is provided an image formation method comprising the following requirements (A01) to (A05):

(A01) a latent image formation step of forming an electrostatic latent image on a surface of an image support (16) at a latent image write position (Q1) set along the turning surface of the image support (16);

(A02) a developing step of developing the electrostatic latent image to a toner image by a developing unit (18*k*, 18*y*, 18*m*, 18*c*) in a developing area (Q2) set along the turning image support (16) surface;

(A03) a primary transfer step, when a turning intermediate transfer body (B) having a resistivity change layer (B2) whose volume resistivity lowers with predetermined physical stimulation given passes through a primary transfer area (Q3) set along the turning image support (16) surface, the primary transfer step of producing a primary transfer electric field between the intermediate transfer body (B) and the image support (16) surface by a primary transfer device (T1) placed facing the image support (16) with the primary transfer area (Q3) between and primarily transferring the toner image on the image support (16) surface to the intermediate transfer body (B);

(A04) a secondary transfer step, when a transfer material (S) transported by a transfer material transporter (42–47) passes through a secondary transfer area (Q4) set along a turn passage of the intermediate transfer body (B), the secondary transfer step of producing a secondary transfer electric field by a secondary transfer device (T2) placed facing the intermediate transfer body (B) passing through the secondary transfer area (Q4) with the transfer material (S) between and secondarily transferring the toner image on the intermediate transfer body (16) surface to the transfer material (S); and (A05) an electricity removal step, when the intermediate transfer body (B) where the secondary transfer step has been executed passes through an electricity removal area (Q5) set downstream from the secondary transfer area (Q4) of the turn passage of the intermediate transfer body (B) and upstream from the primary transfer area (Q3), the electricity removal area (Q5) wherein a conductive member (28*a*) for electricity removal for coming in contact with the intermediate transfer body (B) and supplying charges for electricity removal and a stimulation giving ember (36) for giving predetermined physical stimulation to the intermediate transfer body (B) coming in contact with the conductive member (28*a*) are placed, the electricity removal step of giving physical stimulation to the intermediate transfer body (B) and removing electricity of the intermediate transfer body (B) in a state in which volume resistivity of the resistivity change layer (B2) of the intermediate transfer body (B) is lowered.

(Operation of the First Aspect of the Invention)

At the latent image formation step of the image formation method of the first aspect of the invention comprising the requirements, an electrostatic latent image is formed on the surface of the image support (16) at the latent image write position (Q1) set along the turning surface of the image support (16).

At the developing step, the electrostatic latent image is developed to a toner image by the developing unit (18*k*, 18*y*, 18*m*, 18*c*) in the developing area (Q2) set along the turning image support (16) surface.

At the primary transfer step, when the turning intermediate transfer body (B) having the resistivity change layer (B2) whose volume resistivity lowers with predetermined physical stimulation given passes through the primary transfer area (Q3) set along the turning image support (16) surface, a primary transfer electric field is produced between the intermediate transfer body (B) and the image support (16) surface by the primary transfer device (T1) placed facing the image support (16) with the primary transfer area (Q3) between and the toner image on the image support (16) surface is primarily transferred to the intermediate transfer body (B).

At the secondary transfer step, when a transfer material (S) transported by the transfer material transporter (42–47) passes through the secondary transfer area (Q4) set along the turn passage of the intermediate transfer body (B), a secondary transfer electric field is produced by the secondary transfer device (T2) placed facing the intermediate transfer body (B) passing through the secondary transfer area (Q4) with the transfer material (S) between and the toner image on the intermediate transfer body (16) surface is secondarily transferred to the transfer material (S).

At the electricity removal step, when the intermediate transfer body (B) where the secondary transfer step has been executed passes through the electricity removal area (Q5) set downstream from the secondary transfer area (Q4) of the turn passage of the intermediate transfer body (B) and upstream from the primary transfer area (Q3), the electricity removal area (Q5) wherein the conductive member (28*a*) for electricity removal for coming in contact with the intermediate transfer body (B) and supplying charges for electricity removal and the stimulation giving member (36) for giving predetermined physical stimulation to the intermediate transfer body (B) coming in contact with the conductive member (28*a*) are placed, physical stimulation is given to the intermediate transfer body (B) and electricity of the intermediate transfer body (B) is removed in a state in which the volume resistivity of the resistivity change layer (B2) of the intermediate transfer body (B) is lowered In the image formation method of the first aspect of the invention, the first and second transfer steps are executed in a state in which the volume resistivity of the resistivity change layer (B2) of the intermediate transfer body (B) is high. In this case, charges less move along the surface layer of the intermediate transfer body (B), thus good transfer with toner image less scattering can be executed in the transfer areas (Q3 and Q4).

At the electricity removal step, electricity can be removed in a state in which the volume resistivity of the resistivity change layer (B2) is low. In this case, charges easily move in the resistivity change layer (B2), so that good electricity removal can be executed.

(Second Aspect of the Invention)

To the end, according to a second aspect of the invention, there is provided an image formation system comprising the following requirements (B01) to (B010):

(B01) an image support (16) on which an electrostatic latent image is formed at a latent image write position Q1) set along a turning surface of the image support (16);

(B02) a developing unit (18*k*, 18*y*, 18*m*, 18*c*) for developing the electrostatic latent image to a toner image in a developing area (Q2) set along the image support (16) surface;

(B03) an intermediate transfer body (B) turning through a primary transfer area (Q3) set along the image support (16) surface and passing through a secondary transfer area (Q4) set along a turn passage;

(B04) a primary transfer device (T1) being placed facing the image support (16) with the intermediate transfer body (B) between in the primary transfer area (Q3) for applying a primary transfer voltage to nip between the intermediate transfer body (B) and the image support (16) for transferring the toner image on the image support (16) surface to the intermediate transfer body (B);

(B05) a transfer material transporter (42–47) for transporting a transfer material (S) to the secondary transfer area (Q4) and allowing the transfer material (S) to pass through the secondary transfer area (Q4);

(B06) a secondary transfer device (T2) for applying a secondary transfer voltage to nip between the intermediate transfer body (B) and the transfer material (S) in the secondary transfer area (Q4), thereby transferring the toner image on the intermediate transfer body (B) to the transfer material (S);

(B07) a conductive member (28*a*) for electricity removal for coming in contact with the intermediate transfer body (B) and supplying charges for electricity removal in an electricity removal area (Q5) set downstream from the secondary transfer area (Q4) of the turn passage of the intermediate transfer body (B) and upstream from the primary transfer area (Q3);

(B08) the intermediate transfer body (B) having a resistivity change layer (B2) whose volume resistivity lowers when predetermined physical stimulation is given;

(B09) a stimulation giving member (36) for giving the predetermined physical stimulation to the intermediate transfer body (B) in the electricity removal area (Q5); and (B010) a resistivity controller (C+32*c*+36) for giving physical stimulation to the resistivity change layer (B2) by the stimulation giving member (36) and lowering the volume resistivity of the resistivity change layer (B2) when the intermediate transfer body (B) where secondary transfer has been executed in the secondary transfer area (Q4) passes through the electricity removal area (Q5).

(Operation of Second Aspect of the Invention)

In the image formation system of the second aspect of the invention having the configuration, an electrostatic latent image is formed on the image support (16) surface at the latent image write position (Q1) set along the turning surface of the image support (16). The developing unit (18*k*, 18*y*, 18*m*, 18*c*) develops the electrostatic latent image to a toner image in the developing area (Q2) set along the image support (16) surface;

The intermediate transfer body (B) turning through the primary transfer area (Q3) set along the image support (16) surface passes through the secondary transfer area (Q4) set along the turn passage. The primary transfer device (T1) transfers the toner image on the image support (16) surface to the intermediate transfer body (B) in the primary transfer area (Q3).

The transfer material transporter (42–47) transports a transfer material (S) to the secondary transfer area (Q4) and allowing the transfer material (S) to pass through the secondary transfer area (Q4). The secondary transfer device (T2) applies a secondary transfer voltage to nip between the intermediate transfer body (B) and the transfer material (S) in the secondary transfer area (Q4), thereby transferring the toner image on the intermediate transfer body (B) to the transfer material (S).

The conductive member (28*a*) for electricity removal comes in contact with the intermediate transfer body (B) and supplies charges for electricity removal in the electricity removal area (Q5) set downstream from the secondary transfer area (Q4) of the turn passage of the intermediate transfer body (B) and upstream from the primary transfer area (Q3).

The resistivity controller (c+32*c*+36) gives predetermined physical stimulation to the resistivity change layer (B2) by the stimulation giving member (36) when the intermediate transfer body (B) where secondary transfer has been executed in the secondary transfer area (Q4) passes through the electricity removal area (Q5). The volume resistivity of the resistivity change layer (B2) of the intermediate transfer body (B) lowers in a state in which the physical stimulation is given.

When the volume resistivity lowers, charges of the resistivity change layer (B2) of the intermediate transfer body (B) easily move and electricity is removed. At the time, charges for electricity removal are supplied from the contact portion between the conductive member (28*a*) for electricity removal and the intermediate transfer body (B) to the intermediate transfer body (B) for removing electricity.

(Third Aspect of the Invention)

According to a third aspect of the invention, there is provided an intermediate transfer body (B) comprising the following requirement (C01):

(C01) a resistivity change layer (B2) made of a photoconductive layer (B2) which is a dielectric layer (B2) having high volume resistivity in a state in which light is not applied, and has a charge transport layer (B2*c*) for transporting charges by carriers of either negative-polarity electrons or positive-polarity holes in a state in which light is applied, a charge generation layer (B2*b*) being disposed on the rear face of the charge transport layer (B2*c*) for generating charges in a state in which light in applied, and a blocking layer (B2*a*) being disposed on the rear face of the charge generation layer (B2*b*) for transporting charges by carriers of the opposite polarity to the carriers of the charge transport layer (B2*c*) and suppressing transport of charges by carriers of the same polarity as the carriers of the charge transport layer (B2*c*).

(Operation of Third Aspect of the Invention)

The intermediate transfer body (B) having the configuration can be turned for use so that it passes in order through the primary transfer area (Q3) coming in contact with the surface of the image support (16) of the image formation system, the secondary transfer area (Q4) coming in contact with the transfer material (S), and the electricity removal area (Q5) with which the grounded conductive member (28*a*) for electricity removal comes in contact when the intermediate transfer body (B) passes through the primary transfer area (Q3) in a state of dielectric with no light applied, the toner image on the image support (16) surface is primarily transferred and when the intermediate transfer body (B) passes through the secondary transfer area (Q4), the primarily transferred toner image is secondarily transferred to the transfer material (S).

The resistivity change layer (B2) of the intermediate transfer body (B) is the dielectric layer (B2) and has high volume resistivity in a state in which no light is applied. Thus, the primary transfer and secondary transfer can be executed in a state of the dielectric layer (insulator layer) (B2). In this case, charges less move along the surface of the resistivity change layer (B2) of the intermediate transfer body (B), thus good transfer with toner image less scattering can be executed in the transfer areas (Q3 and Q4).

After the toner image on the intermediate transfer body (B) is secondarily transferred, electricity of the intermediate transfer body (B) can be removed in a state in which the intermediate transfer body (B) is brought into contact with the grounded conductive member (28*a*) for electricity removal placed along the move passage of the intermediate transfer body (B). At the time, light is applied to the intermediate transfer body (B), whereby electricity can be removed in a state in which the volume resistivity of the resistivity change layer (B2) is low. In this case, charges easily move in the resistivity change layer (B2), thus good electricity removal can be executed.

The grounded conductive member (28*a*) for electricity removal can be placed on either the rear face or surface of the intermediate transfer body (B) If the conductive member (28*a*) is placed on the rear face, it can be used in a state in which it is always brought into contact with the rear face of the intermediate transfer body (B); if the conductive member (28*a*) is placed on the surface, it needs to be placed at a position distant from the intermediate transfer body (B) surface until secondary transfer is complete at the multiple transfer time of color toner image and needs to be brought into contact with the intermediate transfer body (B) surface when electricity is removed after secondary transfer is complete. In this case, a move mechanism is required for moving the conductive member (28*a*) for electricity removal between the position at which it comes in contact with the intermediate transfer body (B) and the distant position.

Therefore, if the conductive member (28*a*) for electricity removal is placed so that it is always brought into contact with the rear face of the intermediate transfer body (B), the move mechanism becomes unnecessary and the configuration becomes simple, also reducing costs.

The intermediate transfer body (B) of the third aspect of the invention having the configuration comprises the resistivity change layer (B2) having the charge transport layer (B2*c*), the charge generation layer (B2*b*) disposed on the rear face of the charge transport layer (B2*c*), and the blocking layer (B2*a*) disposed on the rear face of the charge generation layer (B2*b*).

The charge generation layer (B2*b*) disposed on the rear face of the charge transport layer (B2*c*) generates charges in a state in which light is applied. The charge transport layer (B2*c*) transports charges by carriers of either negative-polarity electrons or positive-polarity holes in a state in which light is applied.

For example, if the conductive member (28*a*) for electricity removal is placed so that it is always brought into contact with the rear face of the intermediate transfer body (B) and toner of minus charge polarity is used, when secondary transfer voltage is low, the surface of the photoconductive layer (B2) of the intermediate transfer body (B) after secondary transfer is minus-charged and the rear face is plus-charged, as shown in FIGS. 4B, 7, and 8. When secondary transfer voltage is high, the surface of the photoconductive layer (B2) is plus-charged and the rear face is minus-charged, as shown in FIGS. 4C, 7, and 8.

When the intermediate transfer body (B) with the surface of the photoconductive layer (B2) minus-charged and the rear face plus-charged after the secondary transfer passes through the electricity removal area (Q5), if light is applied to the intermediate transfer body (B), both plus and minus charges are generated in the charge generation layer (B2*b*) of the photoconductive layer (B2). The generated minus charges flow through the blocking layer (B2*a*) into the conductive member (28*a*) for electricity removal (the rear face of the intermediate transfer body (B)). The generated plus charges do not flow into the conductive member (28*a*) for electricity removal (the rear face of the intermediate transfer body (B)) because of the presence of the blocking layer (B2*a*) and flow through the charge transport layer (B2*c*) into the surface for removing electricity.

However, when the intermediate transfer body (B) with the surface of the photoconductive layer (B2) plus-charged and the rear face minus-charged after the secondary transfer passes through the conductive member (28*a*) for electricity removal, even if light is applied to the intermediate transfer body (B), the minus charges generated in the charge generation layer (B2*b*) do not flow into the surface because the charge generation layer (B2*b*) is a hole transport layer. The plus charges generated in the charge generation layer (B2*b*) do not flow into the surface because plus charges accumulate on the surface, and do not flow into the rear face of the intermediate transfer body (B) either because the blocking layer (B2*a*) is an electron transport layer. Thus, the plus charges on the surface of the photoconductive layer (B2) are not removed, in which case electricity removal becomes incomplete.

That is, for the intermediate transfer body (B) using the charge transport layer (B2*c*) for transporting charges by plus carriers and the blocking layer (B2*a*) for inhibiting move of plus carriers and allowing minus carriers to move, secondary transfer voltage needs to be set so that the charge potential on the surface of the photoconductive layer (B2) after the secondary transfer becomes minus.

The charge transport layer (B2*c*) of the photoconductive layer (B2) of the intermediate transfer body (B) of the third aspect of the invention can adopt not only a composition for using carriers of the opposite polarity (plus) to the transferred toner charge polarity (minus) as described above, but also a composition for transporting charges by carriers of the same polarity (minus) as the transferred toner charge polarity. The blocking layer (B2*a*) is made of a material capable of transporting charges by carriers of the opposite polarity to that of the carriers of the charge transport layer (B2*c*).

Therefore, any of the following combinations can be adopted as the composition of the intermediate transfer body (B):

(1) Toner charge polarity is minus, carriers of the charge transport layer (B2*c*) are plus-polarity holes, and carriers of the blocking layer (B2*a*) are minus-polarity electrons;

(2) toner charge polarity is minus, carriers of the charge transport layer (B2*c*) are minus-polarity electrons, and carriers of the blocking layer (B2*a*) are plus-polarity holes;

(3) toner charge polarity is plus, carriers of the charge transport layer (B2*c*) are minus-polarity electrons, and carriers of the blocking layer (B2*a*) are plus-polarity electrons; or (4) toner charge polarity is plus, carriers of the charge transport layer (B2*c*) are plum-polarity holes, and carriers of the blocking layer (B2*a*) are minus-polarity electrons.

Next, when the conductive member (28*a*) for electricity removal is placed so that it is always brought into contact with the rear face of the intermediate transfer body (B) and (1) to (4) described above are applied, the electricity removal functions will be discussed.

(Function of (1) described above wherein the conductive member (28*a*) for electricity removal is placed so that it is always brought into contact with the rear face of the intermediate transfer body (B), toner charge polarity is minus, carriers of the charge transport layer (B2*c*) are plus-polarity holes, and carriers of the blocking layer (B2*a*) are minus-polarity electrons)

The toner charge polarity is minus, charges are moved in the photoconductive layer (B2) by holes of plus carriers of are plus-polarity holes, and charges are moved in the blocking layer (B2*a*) by electrons of minus carriers.

In (1), in FIG. 3B, in the primary transfer area (Q3), to transfer minus toner to the surface of the intermediate transfer body (B), the primary transfer device (T1) applies plus bias voltage to the rear face of the intermediate transfer body (B) with respect to the image support (16). At the time, minus charges containing the charges of the minus-charged toner primarily transferred accumulate on the surface of the photoconductive layer (B2) and plus charges accumulate on the rear face.

To execute multiple transfer of transferring different color toners to the intermediate transfer body (B) in overlapped relation, the intermediate transfer body (B) after the primary transfer passes through the secondary transfer area (Q4) and the electricity removal area (Q5) in order with plus charges accumulating on the rear face of the photoconductive layer (B2). To primarily transfer toner images of four colors to the intermediate transfer body (B) in overlapped relation, at the stage where toner images of the first to third colors have been transferred, secondary transfer is not executed and the intermediate transfer body (B) passes through the electricity removal area (Q5) with plus charges accumulating on the rear face of the photoconductive layer (B2) as described above. In this case, light is not applied to the intermediate transfer body (B) passing through the electricity removal area (Q5).

When the intermediate transfer body (B) passes through the electricity removal area (Q5), the grounded conductive member (28*a*) for electricity removal is in contact with the rear face of the intermediate transfer body (B) in the electricity removal area (Q5). At this time, the plus charges on the rear face of the intermediate transfer body (B) of a dielectric having high volume resistivity are held by the minus charges on the surface opposed to the plus charges and do not flow out into the conductive member (28*a*) for electricity removal.

Therefore, when the intermediate transfer body (B) passes through the conductive member (28*a*) for electricity removal, the plus charges on the rear face of the photoconductive layer (B2), the minus charges on the surface opposed to the plus charges, and toner are maintained. Thus, toner scattering does not occur.

As shown in FIG. 7, when the secondary transfer voltage is low (−500 V or −1000 V), the surface of the photoconductive layer (B2) of the intermediate transfer body (B) after secondary transfer is minus-charged and the rear face is plus-charged (see FIG. 4D). As shown in FIG. 7, when the secondary transfer voltage is high (−1500 V or −2000 V), the surface of the photoconductive layer (B2) is plus-charged and the rear face is minus-charged (see FIG. 4E).

In FIG. 4D, when the intermediate transfer body (B) with the surface of the photoconductive layer (B2) minus-charged and the rear face plus-charged after the secondary transfer passes through the electricity removal area (Q5), if light is applied to the intermediate transfer body (B), plus and minus charges are generated in the charge generation layer (B2*b*). The generated plus charges flow through the charge transport layer (B2*c*) (see FIG. 3) into the surface of the intermediate transfer body (B) for removing electricity, and the generated minus charges flow into the grounded conductive member (28*a*) for electricity removal by carriers of the minus polarity of the blocking layer (B2*a*).

However, as shown in FIG. 4E, when the intermediate transfer body (B) with the surface of the photoconductive layer (B2) plus-charged and the rear face minus-charged after the secondary transfer passes through the electricity removal area (Q5), even if light is applied to the intermediate transfer body (B), the minus charges generated in the charge generation layer (B2*b*) cannot move to the surface through the charge transport layer (B2*c*) of a hole transport layer and do not flow into the conductive member (28*a*) for electricity removal (the rear face of the intermediate transfer body (B)) either because of the presence of the blocking layer (B2*a*) for allowing minus carriers to move. The plus charges generated in the charge generation layer (B2*b*) cannot move to the surface because plus charges exist on the surface of the charge transport layer (B2*c*), and do not flow into the conductive member (28*a*) for electricity removal (the rear face of the intermediate transfer body (B)) either because of the presence of the blocking layer (B2*a*) for inhibiting move of plus carriers. Thus, the plus charges on the surface of the photoconductive layer (B2) are not removed, in which case electricity removal becomes incomplete.

Therefore, if a toner image of minus charge polarity is formed on the image support (16) and the intermediate transfer body (B) is provided with the charge transport layer (B2*c*) for moving charges by plus carriers and the blocking layer (B2*a*) for inhibiting move of plus carriers, it is necessary to apply secondary transfer voltage such that the charge potential on the surface of the photoconductive layer (B2), namely, the surface of the intermediate transfer body (B) after secondary transfer becomes minus.

(Function of (2) described above wherein the conductive member (28*a*) for electricity removal is placed so that it is always brought into contact with the rear face of the intermediate transfer body (B), toner charge polarity is minus, carriers of the charge transport layer (B2*c*) are minus-polarity electrons, and carriers of the blocking layer (B2*a*) are plus-polarity holes)

In (2), if the surface of the intermediate transfer body (B) is plus-charged after secondary transfer, the minus charges generated when light is applied to the charge generation layer (B2*b*) of the intermediate transfer body (B) in the electricity removal area (Q5) move through the charge transport layer (B2*c*) to the surface, removing plus charges on the surface. The plus charges generated in the charge transport layer (B2*c*) flow through the blocking layer (B2*a*) into the conductive member (28*a*) for electricity removal.

However, when the intermediate transfer body (B) with the surface of the photoconductive layer (B2) minus-charged and the rear face plus-charged after the secondary transfer passes through the electricity removal area (Q5), even if light is applied to the intermediate transfer body (B), the plus charges generated in the charge generation layer (B2*b*) cannot move to the surface through the charge transport layer (B2*c*) for transporting charges by minus carriers and cannot flow into the conductive member (28*a*) for electricity removal (the rear face of the intermediate transfer body (B)) through the blocking layer (B2*a*) for allowing plus carriers to move because plus charges exist on the rear face. Thus, the minus charges on the surface of the photoconductive layer (B2) are not removed, in which case electricity removal becomes incomplete.

Therefore, if a toner image of minus charge polarity is formed on the image support (16) and the intermediate transfer body (B) is provided with the charge transport layer (B2*c*) for moving charges by minus carriers and the blocking layer (B2*a*) for inhibiting move of minus carriers, it is necessary to apply secondary transfer voltage such that the charge potential on the surface of the photoconductive layer (B2), namely, the surface of the intermediate transfer body (B) after secondary transfer becomes plus.

(Function of (3) described above wherein the conductive member (28*a*) for electricity removal is placed so that it is always brought into contact with the rear face of the intermediate transfer body (B), toner charge polarity is plus, carriers of the charge transport layer (B2*c*) are minus-polarity electrons, and carriers of the blocking layer (B2*a*) are plus-polarity electrons)

In (3), if the charge potential on the surface of the intermediate transfer body (B) after secondary transfer is plus, the minus charges generated in the charge generation layer (B2*b*) by light application in the electricity removal area (Q5) pass through the charge transport layer (B2*c*), removing plus charges on the surface of the intermediate transfer body (B). The plus charges generated in the charge generation layer (B2*b*) pass through the blocking layer (B2*a*), removing minus charges on the rear face.

However, in (3), when the charge potential on the surface of the intermediate transfer body (B) after the secondary transfer is minus, the plus charges generated in the charge generation layer (B2*b*) by light application in the electricity removal area (Q5) cannot move to the surface through the charge transport layer (B2*c*) for transporting charges by minus carriers and cannot flow into the rear face through the blocking layer (B2*a*) because of plus charges on the rear face. Thus, the minus charges on the surface of the intermediate transfer body (B) cannot be removed.

Therefore, if a toner image of plus charge polarity is formed on the image support (16) and the intermediate transfer body (B) is provided with the charge transport layer (B2*c*) for moving charges by minus carriers and the blocking layer (B2*a*) for inhibiting move of minus carriers, it is necessary to apply secondary transfer voltage such that the charge potential on the surface of the photoconductive layer (B2), namely, the surface of the intermediate transfer body (B) after secondary transfer becomes plus.

(Function of (4) described above wherein the conductive member (28*a*) for electricity removal is placed so that it is always brought into contact with the rear face of the intermediate transfer body (B), toner charge polarity is plus, carriers of the charge transport layer (B2*c*) are plus-polarity holes, and carriers of the blocking layer (B2*a*) are minus-polarity electrons)

In (4), if the charge potential an the surface of the intermediate transfer body (B) after secondary transfer is minus, the plus charges generated in the charge generation layer (B2*b*) by light application in the electricity removal area (Q5) pass through the charge transport layer (B2*c*) for transporting charges by plus carriers, removing minus charges on the surface of the intermediate transfer body (B). The minus charges generated in the charge generation layer (B2*b*) flow through the blocking layer (B2*a*) of minus carriers into the conductive member (28*a*) for electricity removal.

However, in (4), when the charge potential on the surface of the intermediate transfer body (B) after the secondary transfer is plus, the minus charges generated in the charge generation layer (B2*b*) by light application in the electricity removal area (Q5) cannot move to the surface through the charge transport layer (B2*c*) for transporting charges by plus carriers and cannot flow into the rear face through the blocking layer (B2*a*) because of minus charges on the rear face. That is, the plus charges on the surface of the intermediate transfer body (8) cannot be removed.

Therefore, if a toner image of plus charge polarity is formed on the image support (16) and the intermediate transfer body (B) is provided with the charge transport layer (B2*c*) for moving charges by plus carriers and the blocking layer (B2*a*) for inhibiting move of plus carriers, it is necessary to apply secondary transfer voltage such that the charge potential on the surface of the photoconductive layer (B2), namely, the surface of the intermediate transfer body (B) after secondary transfer becomes minus.

(Fourth Aspect of the Invention)

According to a fourth aspect of the invention, there is provided an image formation method comprising the steps of:

primarily transferring a toner image held on an image support to an intermediate transfer body by a primary transfer device, secondarily transferring the toner image from the intermediate transfer body to a transfer material by a secondary transfer body, after the step of secondarily transferring the toner image is executed, the physical stimulation is given to the intermediate transfer body for lowering the volume resistivity thereof, and forming an image, wherein the intermediate transfer body has a resistivity lowering layer whose volume resistivity lowers in a state in which predetermined physical stimulation is given.

(Fifth Aspect of the Invention)

According to a fifth aspect of the invention, there is provided an image formation system comprising:

an image support on which an electrostatic latent image is formed;

a developing unit for developing the electrostatic latent image formed on the image support to a toner image on the image support;

an intermediate transfer body for temporarily holding the toner image, the intermediate transfer body having volume resistivity lowering in a state in which predetermined physical stimulation is given;

a primary transfer device for primarily transferring the toner image formed by the developing unit to the intermediate transfer body;

a secondary transfer device for secondarily transferring the toner image held on the intermediate transfer body to a transfer material; and a physical stimulation giving member being placed downstream from the secondary transfer device for giving physical stimulation to the intermediate transfer body where the secondary transfer has been executed for lowering the volume resistivity of the intermediate transfer body.

There is provided an image formation system of the fifth aspect, further comprising:

an electricity removal member being placed downstream from the secondary transfer device for coming in electric contact with the intermediate transfer body having the volume resistivity lowering as a result of giving the physical stimulation to the intermediate transfer body.

There is provided an image formation system of the fifth aspect, wherein the physical stimulation giving member is light application means for applying light.

There is provided an image formation system of the fifth aspect, wherein the intermediate transfer body is a dielectric having high volume resistivity in a state in which light is not applied, and is a conductor having low volume resistivity in a state in which light is applied.

There is provided an image formation system of the fifth aspect, wherein the intermediate transfer body has volume resistivity of $10^{14}$ Ωcm or more.

There is provided an image formation system of the fifth aspect, wherein the intermediate transfer body comprises:

a charge transport layer for transporting charges by carriers of negative-polarity or positive-polarity, a charge generation layer for generating charges in a state in which light is applied, and a blocking layer for allowing carriers of the opposite polarity to the carriers of the charge transport layer to move and inhibiting move of carriers of the same polarity as the carriers of the charge transport layer.

There is provided an image formation system of the fifth aspect, wherein when the surface potential of the intermediate transfer body after the secondary transfer is of negative polarity, the charge transport layer transports charges by carriers of positive polarity and the blocking layer inhibits move of carriers of positive polarity and allows carriers of negative polarity to move.

There is provided an image formation system of the fifth aspect, wherein when the surface potential of the intermediate transfer body after the secondary transfer is of positive polarity, the charge transport layer transports charges by carriers of negative polarity, and the blocking layer inhibits move of carriers of negative polarity and allows carriers of positive polarity to move.

DESCRIPTION OF THE INVENTION

The intermediate transfer body (B) used with the image formation system of the invention can be formed like a belt or a drum. In the intermediate transfer body (B), the resistivity change layer (B2) whose volume resistivity lowers as predetermined physical stimulation is given can be manufactured, for example, by adding a photoconductive substance to an intermediate transfer body material or applying one or more photosensitive layers onto the sheet-like belt base material (B1).

When no light is applied, the intermediate transfer body (B) has volume resistivity of a dielectric; when light is applied, the intermediate transfer body (B) shows conductivity. Therefore, primary transfer and secondary transfer are executed with no light applied. At this time, the intermediate transfer body (B) has high volume resistivity like a dielectric. If an intermediate transfer body having high volume resistivity is used as the intermediate transfer body (B) and a transfer voltage is applied by the transfer roll, a good transfer image with no transfer electric field spread can be provided.

In the secondary transfer area (Q4) where secondary transfer is executed in the image formation system, secondary transfer can be executed in a state in which the intermediate transfer body (B) is sandwiched between the inner secondary transfer roll placed on the rear face side and the outer secondary transfer roll placed on the surface side. In this case, at the secondary transfer time, a transfer material (S) such as a recording sheet is sandwiched between the intermediate transfer body (B) and the outer secondary transfer roll (30). Since the transfer material (S) is narrower than the intermediate transfer body (B) and the outer secondary transfer roll (30), in the portion outside the transfer material (S), the transfer material (S) is not sandwiched and the intermediate transfer body (B) and the outer secondary transfer roll (30) come in direct contact with each other. If the volume resistivity of the intermediate transfer body (B) is small as compared with that of the transfer material (S), current flows into the direct contact portion between the intermediate transfer body (B) and the outer secondary transfer roll (30).

In this case, the transfer electric field applied to the center portion of the transfer material (S) differs from that to the outer peripheral portion. At this time, necessary transfer electric field may not be provided in the outer peripheral portion of the transfer material (S).

Therefore, it is desired that the volume resistivity of the intermediate transfer body (B) is almost equal to or more than that of the transfer material (S) such as a recording sheet.

In the invention, if resistivity change layer (B2) having volume resistivity ρ of more than $10^{14}$ with no light applied is provided, the volume resistivity ρ of the resistivity change layer (B2) becomes almost equal to or greater than the volume resistivity of an OHP sheet (about $10^{14}$ Ωcm) having high volume resistivity among transfer materials (S).

A color OHP sheet has volume resistivity of about $10^{15}$ Ωcm and volume resistivity becomes about $10^{14}$ Ωcm at the rear side copy time of double-sided copy paper in a low-temperature, low-humidity environment (10°C., 15%). Thus, preferably the volume resistivity of the resistivity change layer (B2) of the intermediate transfer body (B) with no light applied is set to $\rho > 10^{15}$.

In this case, stable secondary transfer can be executed regardless of the type of transfer material (S). Any other volume resistivity of the intermediate transfer body than the above-mentioned values can be used. Even in the case, the volume resistivity at the electricity removal time can be made lower than that at the transfer time, so that comparatively good transfer and electricity removal can be accomplished.

In the invention, the charge characteristic of toner may be negative or positive polarity, but negative-polarity toner is used in the description for convenience.

With negative-polarity toner, a positive voltage is applied to the primary transfer roll (primary transfer device) (T1) for executing primary transfer, as shown in FIGS. 3B and 4A. Positive charges produced by the primary transfer roll accumulate on the rear face of the intermediate transfer body (B) after primary transfer and negative charges produced by toner and countercharges accumulate on the surface. To provide a color image, the primary transfer voltage may be raised in order from the second color to the last color for forming toner images of different colors on the intermediate transfer body (B).

The function provided when an intermediate transfer body (B) having high volume resistivity is used will be discussed.

In secondary transfer, as shown in FIGS. 4B and 4C, when toner image is transferred to a transfer material (S), etc., uneven positive charges responsive to a secondary transfer image are supplied to the surface of the intermediate transfer body (B) and negative charges are supplied to the rear face. When secondary transfer voltage is low, the surface potential of the intermediate transfer body (B) after the secondary transfer becomes minus as shown in FIG. 4B; when secondary transfer voltage is high, the surface potential of the intermediate transfer body (B) after the secondary transfer becomes plus as shown in FIG. 4C.

For example, if the primary transfer step of the next image is executed in the state shown in FIG. 4B, primary transfer unevenness caused by unevenly accumulated charges causes disorder of image blurring, scattering, overweight (overthickness), etc. Further, if a mechanism for removing electricity on the surface of the intermediate transfer body (B) does not exist and negative charges accumulate still after secondary transfer, whenever primary transfer and secondary transfer are repeated, charges accumulate and the surface potential of the intermediate transfer body (B) becomes an excessively high minus value (excessively high plus surface potential on the rear face), so that the primary transfer voltage required for the next image also becomes very high. Thus, it becomes necessary to set the charges accumulated on the intermediate transfer body (B) uniformly to a constant level or less after the secondary transfer.

The constant level refers to the level determined in response to the image support (16) surface potential, toner charge amount, before-transfer area form, etc.

In the invention, if the resistivity change layer (B2) whose volume resistivity lowers as it is physically stimulated in made of the photoconductive layer (B2) whose volume resistivity lowers upon light application, as shown in FIGS. 4D and 4C, light is applied to the intermediate transfer body (B) by the electricity removal lamp (stimulation giving member) (36) after secondary transfer, whereby accumulated charges can be canceled easily, because the photoconductive substance in the intermediate transfer body (B) generates free carriers upon light application, neutralizing countercharges. The electricity removal lamp (36) may have the photosensitive area wavelength of the added photoconductive substance and the strength and electricity removal position by light application may be determined whenever necessary.

The conventional intermediate transfer body (B) with carbon or metal filler dispersed has a resistance value lowering with time as printout is produced repeatedly, and has large variations in resistance value distribution. In contrast, hitherto, the photoconductive substance has been used as a material of image support (photosensitive drum) (16) and usually image disorder caused by the dispersion state of the photoconductive substance is not observed on toner developed images on the image support (photosensitive drum) (16).

Thus, it is considered that the dispersion state of the photoconductive substance in polymeric resin in the intermediate transfer body (B) is small-diameter and uniform dispersion as compared with carbon black and metal oxide.

Resultantly, variations in volume resistivity can be made small and volume resistivity lowering with time can also be suppressed.

Like the conventional electrophotographic photosensitive body, the resistivity change layer (B2) can adopt the three-layer structure of the blocking layer (B2*a*), the charge generation layer (B2*b*), and the charge transport layer (B2*c*). In this case, the charge generation layer (B2*b*), the charge transport layer (B2*c*), and the blocking layer (B2*a*) can be formed as follows:

To form the charge generation layer (B2*b*), a charge generation material is dispersed in a binding resin and is applied by a spray application method, an immersion application method, etc., then is dried or a film is formed directly of a charge generation material by a vacuum evaporation method, etc.

For example, azo dye of chlorodyeale, etc., quinone pigment of anthoanthoron, pyrene quinone, etc., quino cyanine pigment, perylene pigment, perinone pigment, indigo pigment, is bisbenzimidazole pigment, phthalocyanine pigment (copper phthalocyanine, vanadil phthalocyanine, titanyl phthalocyanine, etc.,), azuleniume salt, squarerium pigment, quinacridon pigment, etc., can be used as the charge generation material.

An insulating resin such as polyvinyl butyral, polyarylate (polycondensate of biaphenol A and phthalic acid), polycarbonate resin, polyester resin, phenoxy resin, vinyl chloride-vinyl acetate copolymer, polyvinyl acetate, acrylic resin, polyacrylamide, polyamide resin, polyvinyl pyridine, cellulosic resin, urethane resin, epoxy resin, casein, polyvinyl alcohol, or polyvinyl pyrrolidone can be used as the binding resin.

To form the charge transport layer (B2*c*), a solution of solving a binding resin in a solvent to which a charge transfer material is added is applied by a spray application method, an immersion application method, etc., then is dried.

For example, a polycyclic aromatic compound such as anthracene, pyrene, or phenanthrene, a compound having nitrogen-containing heterocycle such as indole, carbazole, or imidezole, a pyrazoline compound, a hydrazone compound, a triphenylmethane compound, a triphenyl amine compound, an enermine compound, or a stilbene compound can be used as the charge transfer material.

Various resins having a film formation property can be used as the binding resin; for example, polyester, polysulfone, polycarbonate, poly methyl methacrylate, etc., can be used.

For example, the blocking layer (B2*a*) can be formed as follows:

A material comprising an organic zirconium compound of a zirconium chelate compound, zirconium alkoxide, etc., or a silane coupling agent added to a resin of poly-para-xylene, casein, polyvinyl alcohol, phenol resin, polyvinyl acetal resin, melamine resin, nitrocellulose, ethylene acrylate copolymer, polyamide (nylon, nylon 66, nylon 610, mixed nylon, alkoxymethylation nylon, etc.,), polyurethane, gelatin, polyvinyl pirrolidone, polyvinyl viridin, polyvinyl methyl ether, etc., is mixed with a solvent (ethanol, methanol, etc.,), and is applied onto the base material (B1), then is dried.

For example, the blocking layer (B2*a*) can be formed as follows:

Zirconium trybotoxy acetylacetonate, dipropoxybis (acetylacetonate) titanium, diisopropoxybis (acetylacetonate) aluminum, etc., is mixed with a solvent and is applied onto the base material (B1), then is dried.

In this case, a silane coupling agent may be mixed.

Vinyl trichloro silane, vinyl trinethoxy silane, vinyl triethoxy silane, vinyl tris-2-methoxy ethoxy silane, vinyl triacetoxy silane, γ-glycidoxy propyl trimethoxy silane, γ-methacryloxy propyl trimethoxy silane, γ-amino propyl triethoxy silane, γ-chloro propyl trimethoxy silane, γ-2-amino ethyl amino propyl trimethoxy silane, γ-mercapto propyl trimethoxy silane, γ-ureide propyl triethoxy silane, γ-3,4-epoxy cyclohexyl ethyl trimethoxy silane, etc., can be used as the silane coupling agent.

The intermediate transfer body (B) may be formed as a single layer or multiple layers. To form the intermediate transfer body (B) an two layers, for example, the lower layer (base material) may be a semiconductive layer, mechanical strength may be provided, and the photoconductive layer (B2) as an upper layer may be formed on the base material (B1). To form the intermediate transfer body (B) as three layers, the blocking layer (B2*a*) and a charge generation and transport layer (B3) may be placed in order on the base material (semiconductive layer) (B1) of the bottom layer. To form the intermediate transfer body (B) as a single layer, only the photoconductive layer (B2) is formed and polymer seed, photoconductive substance seed, and addition amount are adjusted to provide necessary mechanical strength.

A method of using a drum-like intermediate transfer body (B) can also be adopted in addition to a method of using a belt-like intermediate transfer body (B) having photoconductivity placed on rolls. In the former method, an elastic layer may be placed on a rigid body such as a metal roll and a photoconductive layer (B2) of a single-layer or multiple-layer structure may be placed on the surface of the elastic layer. In this case, for example, when primary transfer from the image support (photosensitive body) (16) to the intermediate transfer body (B) is executed, a transfer voltage is applied to the metal roll. When toner on the intermediate transfer body (B) is secondarily transferred to a transfer material (S) such as a recording sheet, connection of the metal roll of the intermediate transfer body (B) can be changed from primary transfer power supply to ground, the outer secondary transfer roll (30) out of contact with the intermediate transfer body (B) at the primary transfer time can be pressed against the intermediate transfer body (B) from the rear face of the transfer material (S), and secondary transfer voltage can be applied to the outer secondary transfer roll (30). The charges accumulated on the intermediate transfer body (B) can be easily canceled by applying light to the intermediate transfer body (B) after the secondary transfer.

BRIEF DESCRIPTION OF THE DRAWINGS

In the accompanying drawings:

FIG. 4A is a schematic representation of the transfer operation in primary area; FIG. 43 is a schematic representation to show charges on the intermediate transfer belt B after secondary transfer when secondary transfer voltage is low; FIG. 4C is a schematic representation to show charges on the intermediate transfer belt B after secondary transfer when secondary transfer voltage is high; FIG. 4D is a schematic representation to show charges on the intermediate transfer belt B after electricity removal when secondary transfer voltage is low; and FIG. 4E is a schematic representation to show charges on the intermediate transfer belt B after electricity removal when secondary transfer voltage is high;

FIG. 6 is a table to show the relationship between the surface potentials of center and outer peripheral portions of OHP paper having high volume resistivity and the volume resistivities of intermediate transfer belts when the OHP paper passes through secondary transfer area;

FIG. 8 is a table to show surface charge potentials of the intermediate transfer belt B after primary transfer of toner images of first to fourth colors at the full color image formation time, after secondary transfer after the primary transfer of the toner image of the fourth color, and after electricity removal by light application after the secondary transfer;

Figure 1:
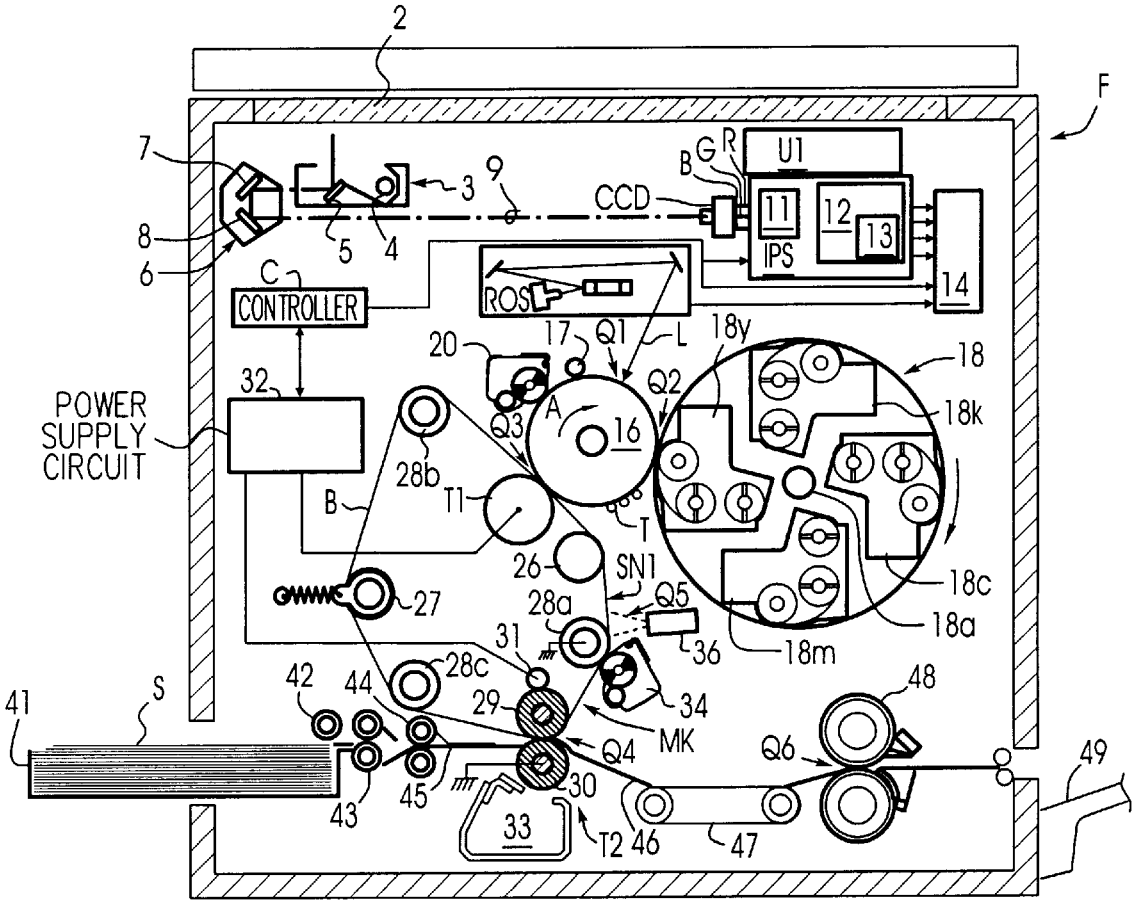
FIG. 1 is a general schematic representation of a first example of an image formation system using an intermediate transfer body of the invention.

DETAILED DESCRIPTION OF THE PREFERRED EMBODIMENTS (First Embodiment of First Aspect of the Invention)

The image formation method of the first embodiment of the first aspect of the invention comprises the following requirement (A06) in the first aspect of the invention: (A06) the conductive member for electricity removal is grounded.

(Operation of First Embodiment of First Aspect of the Invention)

In the image formation method of the first embodiment of the first aspect of the invention comprising the configuration, the conductive member (28*a*) for electricity removal is grounded. Therefore, at the electricity removal step of removing electricity in a state in which the volume resistivity of the resistivity change layer (B2) is low, charges which easily move in the resistivity change layer (B2) of the intermediate transfer body (B) and are opposite in polarity again combine and the remaining charges flow into the grounded conductive member and are removed.

In this case, a power supply for electricity removal is not required, so that the configuration can be simplified and costs can be reduced.

(Second Embodiment of First Aspect of the Invention)

The image formation method of the second embodiment of the first aspect of the invention comprises the following requirements (A07) and (A08) in the first aspect of the invention or the first embodiment of the first aspect of the invention: (A07) the predetermined physical stimulation is light application and the intermediate transfer body (B) has the resistivity change layer (B2) which is a dielectric having high volume resistivity in a state in which light is not applied, and becomes a photoconductive layer (B2) having low volume resistivity in a state in which light is applied; and (A08) the stimulation giving member (36) being made of an electricity removal lamp (36).

(Operation of Second Embodiment of First Aspect of the Invention)

In the image formation method of the second embodiment of the first aspect of the invention comprising the configuration, the resistivity change layer (B2) of the intermediate transfer body (B) is a dielectric having high volume resistivity in a state in which light is not applied, and becomes a photoconductive layer (B2) having low volume resistivity in a state in which light is applied. In the electricity removal area (Q5), light is applied by the electricity removal lamp forming the stimulation giving member.

The volume resistivity of the resistivity change layer (B2) of the intermediate transfer body (B) with light applied in the electricity removal area (Q5) lowers and charges easily move, thus good electricity removal can be executed.

Third Embodiment of First Aspect of the Invention)

The image formation method of the third embodiment of the first aspect of the invention comprises the following requirement (A09) in the second embodiment of the first aspect of the invention;

(A09) the resistivity change layer (B2) is a dielectric having volume resistivity p calculated according to the following expression (1) satisfying the following expression (2):

$$\rho = RS/L \quad (1)$$

$$\rho > 10^{14}\ \Omega\text{cm} \quad (2)$$

wherein R is a measurement resistance value between the surface and rear face of the resistivity change layer (B2) in a state in which light is not applied, L is the distance between the surface and rear face, and S is the area of the measurement portion.

(Operation of Third Embodiment of First Aspect of the Invention)

In the image formation method of the third embodiment of the first aspect of the invention comprising the configuration, the resistivity change layer (B2) which is a dielectric in a state in which light is not applied has volume resistivity ρ calculated according to the following expression (1) satisfying the following expression (2):

$$\rho = RS/L \quad (1)$$

$$\rho > 10^{14}\ \Omega\text{cm} \quad (2)$$

wherein R is a measurement resistance value between the surface and rear face of the resistivity change layer (B2), L is the distance between the surface and rear face, and S is the area of the measurement portion.

Since the resistivity change layer (B2) has high volume resistivity ρ in a state in which light is not applied, charges less move along the surface of the resistivity change layer (B2) of the intermediate transfer body (B) at the primary or secondary transfer time. Thus, good transfer with toner image less scattering can be executed in the transfer areas (Q3 and 04).

(Fourth Embodiment of First Aspect of the Invention)

The image formation method of the fourth embodiment of the first aspect of the invention comprises the following requirements (A010) and (A011) in the first aspect of the invention or the first embodiment of the first aspect of the invention:

(A010) to give the predetermined physical stimulation is to apply pressure and the intermediate transfer body (B) has a resistivity change layer (B2) whose volume resistivity changes as pressure is applied, and lowers in a state in which pressure is applied; and (A011) the stimulation giving member is made up of a pressure application member on the surface side supported for move between a press position where the pressure application member is pressed against the surface of the intermediate transfer body (B) in the electricity removal area (Q5) and a distant position where the pressure application member is away from the surface of the intermediate transfer body (B) and a pressure application member on the rear side for sandwiching the intermediate transfer body between the pressure application member on the surface side and the pressure application member on the rear side when the pressure application member on the surface side moves to the press position and the conductive member for electricity removal is made of the pressure application member on the surface side or the pressure application member on the rear side.

(Operation of Fourth Embodiment of First Aspect of the Invention)

In the image formation method of the fourth embodiment of the first aspect of the invention comprising the configuration, the pressure application member on the surface aide forming a part of the stimulation giving member is supported for move between the press position where the pressure application member is pressed toward the pressure application member on the rear side from the surface of the intermediate transfer body (B) in the electricity removal area (Q5) and the distant position where the pressure application member is away from the surface of the intermediate transfer body (B). When the pressure application member on the surface side moves to the press position, pressure (predetermined physical stimulation) is applied to the intermediate transfer body (B). The volume resistivity of the resistivity change layer (B2) of the intermediate transfer body (B) lowers in a state in which pressure is applied.

Therefore, electricity of the intermediate transfer body (B) can be removed in a state in which the volume resistivity lowers, so that good electricity removal can be executed.

(First Embodiment of Second Aspect of the Invention)

The image formation system of the first embodiment of the second aspect of the invention comprises the following requirement (B011) in the second aspect of the invention: (B011) the conductive member for electricity removal is grounded.

(Operation of First Embodiment of Second Aspect of the Invention)

In the image formation system of the first embodiment of the second aspect of the invention comprising the configuration, the conductive member (28*a*) for electricity removal is grounded. Therefore, when electricity is removed in a state in which the volume resistivity of the resistivity change layer (B2) is low, charges which easily move in the resistivity change layer (B2) of the intermediate transfer body (B) and are opposite in polarity again combine and the remaining charges flow into the grounded conductive member and are removed.

In this case, a power supply for electricity removal is not required, so that the configuration can be simplified and costs can be reduced.

(Second Embodiment of Second Aspect of the Invention)

The image formation system of the second embodiment of the second aspect of the invention comprises the following requirements (B012) to (B014) in the second aspect of the invention or the first embodiment of the second aspect of the invention;

(B012) to give the physical stimulation is to apply light and the intermediate transfer body (B) has the resistivity change layer (B2) whose resistance value changes as light is applied, and whose volume resistivity lowers in a state in which light is applied;

(B013) the stimulation giving member (36) being made of an electricity removal lamp (36) for applying electricity removal light to the intermediate transfer body (B) in the electricity removal area (Q5); and (B014) the resistivity controller (C+32*c*+36) having a light source control circuit (C+32*c*) for turning on the electricity removal lamp (36) when the intermediate transfer body (B) where secondary transfer has been executed in the secondary transfer area (Q4) passes through the electricity removal area (Q5), thereby applying light to the resistivity change layer (B2) for lowering the volume resistivity of the resistivity change layer (B2).

(Operation of Second Embodiment of Second Aspect of the Invention)

In the image formation system of the second embodiment of the second aspect of the invention comprising the configuration, the resistivity change layer (B2) of the intermediate transfer body (B) has a resistance value changing as light is applied (predetermined physical stimulation is given). The volume resistivity of the intermediate transfer body (B) lowers in a state in which light is applied.

The resistivity controller (C+32*c*+36) having the light source control circuit (C+32*c*) turns on the electricity removal lamp (stimulation giving member) (36) when the intermediate transfer body (B) where secondary transfer has been executed in the secondary transfer area (Q4) passes through the electricity removal area (Q5), thereby applying light to the resistivity change layer (B2) for lowering the volume resistivity of the resistivity change layer (B2).

The volume resistivity of the resistivity change layer (B2) of the intermediate transfer body (B) with light applied in the electricity removal area (Q5) lowers, the resistance value between the surface and rear face of the intermediate transfer body (B) lowers, and charges easily move, thus good electricity removal can be executed.

(Third Embodiment of Second Aspect of the Invention)

The image formation system of the third embodiment of the second aspect of the invention comprises the following requirement (B015) in the second embodiment of the second aspect of the invention:

(B015) the intermediate transfer body having the resistivity change layer which is a dielectric having high volume resistivity in a state in which light is not applied and becomes a photoconductive layer having volume resistivity lowering in a state in which light is applied.

(Operation of Third Embodiment of Second Aspect of the Invention)

In the image formation system of the third embodiment of the second aspect of the invention comprising the configuration, the resistivity change layer (B2) of the intermediate transfer body (B) is a dielectric layer (B2) and has high volume resistivity in a state in which light is not applied, and becomes a photoconductive layer (B2) having volume resistivity lowering in a state in which light is applied.

In the primary transfer area (Q3) and the secondary transfer area (Q4), the resistivity change layer (B2) of the intermediate transfer body (B) is the dielectric layer (B2) and transfer can be executed in a state in which the volume resistivity is high. In this case, charges less move along the surface of the resistivity change layer (B2) of the intermediate transfer body (B), thus good transfer with toner image less scattering can be executed in the transfer area.

The volume resistivity of the resistivity change layer (B2) of the intermediate transfer body (B) with light applied in the electricity removal area (Q5) lowers and charges easily move, thus good electricity removal can be executed.

(Fourth Embodiment of Second Aspect of the Invention)

The image formation system of the fourth embodiment of the second aspect of the invention comprises the following requirement (B016) in the third embodiment of the second aspect of the invention:

(B016) the resistivity change layer (B2) is a dielectric having volume resistivity p calculated according to the following expression (1) satisfying the following expression (2):

$$\rho = RS/L \quad (1)$$

$$\rho > 10^{14}\ \Omega\text{cm} \quad (2)$$

wherein R is a measurement resistance value between the surface and rear face of the resistivity change layer (B2) in a state in which light is not applied, L is the distance between the surface and rear face, and S is the area of the measurement portion.

(Operation of Fourth Embodiment of Second Aspect of the Invention)

In the image formation system of the fourth embodiment of the second aspect of the invention comprising the configuration, the resistivity change layer (B2) of the intermediate transfer body (B) is a dielectric having volume resistivity ρ calculated according to the following expression (1) satisfying the following expression (2):

$$\rho = RS/L \quad (1)$$

$$\rho > 10^{14}\ \Omega\text{cm} \quad (2)$$

wherein R is a measurement resistance value between the surface and rear face of the resistivity change layer (B2) in a state in which light is not applied, L is the distance between the surface and rear face, and S is the area of the measurement portion.

Therefore, transfer can be executed in a state of very high volume resistivity, the state satisfying the expression (2). In this case, charges less move along the surface of the resistivity change layer (B2) of the intermediate transfer body (B), thus good transfer with toner image less scattering can be executed in the transfer area.

Electricity can be removed in a state in which the volume resistivity of the resistivity change layer (B2) lowers with light applied to the intermediate transfer body (B) in the electricity removal area (Q5). In this case, charges of the resistivity change layer (B2) of the intermediate transfer body (B) easily move, thus good electricity removal can be executed.

(Fifth Embodiment of Second Aspect of the Invention)

The image formation system of the fifth embodiment of the second aspect of the invention comprises the following requirement (B017) in the third or fourth embodiment of the second aspect of the invention:

(B017) the intermediate transfer body (B) comprising the resistivity change layer (B2) having a charge transport layer (B2*c*) for transporting charges by carriers of either negative-polarity electrons or positive-polarity holes in a state in which light is applied, a charge generation layer (B2*b*) being disposed on the rear face of the charge transport layer (B2*c*) for generating charges in a state in which light is applied, and a blocking layer (B2*a*) being disposed on the rear face of the charge generation layer (B2*b*) for allowing carriers of the opposite polarity to the carriers of the charge transport layer (B2*c*) to move and inhibiting move of carriers of the same polarity as the carriers of the charge transport layer (B2*c*).

(Operation of Fifth Embodiment of Second Aspect of the Invention)

In the image formation system of the fifth embodiment of the second aspect of the invention comprising the configuration, the resistivity change layer (B2) has the charge transport layer (B2*c*) and the charge generation layer (B2*b*) disposed on the rear face of the charge transport layer (B2*c*). The charge generation layer (B2*b*) disposed on the rear face of the charge transport layer (B2*c*) generates charges in a state in which light is applied. The charge transport layer (B2*c*) transports charges by carriers of either negative-polarity electrons or positive-polarity holes in a state in which light is applied.

The blocking layer (B2*a*) disposed on the rear face of the charge generation layer (B2*b*) of the resistivity change layer (B2) of the intermediate transfer body (B) transports charges by carriers of the opposite polarity to the carriers of the charge transport layer (B2*c*) and does not transport charges by carriers of the said polarity as the carriers of the charge transport layer (B2*c*).

The operation performed when the intermediate transfer body (B) has the charge transport layer (B2*c*), the charge generation layer (B2*b*), and the blocking layer (B2*a*) is used is as described in (operation of third aspect of the invention).

(Sixth Embodiment of Second Aspect of the Invention)

The image formation system of the sixth embodiment of the second aspect of the invention comprises the following requirement (B018) in the fifth embodiment of the second aspect of the invention:

(B018) the intermediate transfer body (B) having a semiconductive sheet-like base material (B1) having mechanical strength being disposed on the rear face of the blocking layer (B2*a*).

(Operation of Sixth Embodiment of Second Aspect of the Invention)

In the image formation system of the sixth embodiment of the second aspect of the invention comprising the configuration, the intermediate transfer body (B) has the semiconductive sheet-like base material (B1) having mechanical strength disposed on the rear face of the blocking layer (B2*a*). Therefore, the intermediate transfer body (B) having necessary mechanical strength can be manufactured easily. The volume resistivity of the semiconductive sheet-like base material (B1) is adjusted properly, whereby the attenuation speed of the charges of the intermediate transfer body (B) accumulated at the primary transfer time can be controlled. That is, the intermediate transfer body (B) can be prevented from being charged up or secondary transfer current can be prevented from flowing out by controlling the attenuation speed of the charges.

(Seventh Embodiment of Second Aspect of the Invention)

The image formation system of the seventh embodiment of the second aspect of the invention comprises the following requirements (B019) to (B021) in the second aspect of the invention or the first embodiment of the second aspect of the invention:

(B019) to give the predetermined physical stimulation is to apply pressure and the intermediate transfer body has a resistivity change layer (B2) whose volume resistivity changes as pressure is applied, and lowers in a state in which pressure is applied; (B020) the stimulation giving member (36) is made of a pressure application member supported for move between a press position where the pressure application member is pressed toward the conductive member for electricity removal from the surface of the intermediate transfer body (B) in the electricity removal area (Q5) and a distant position where the pressure application member is away from the surface of the intermediate transfer body (B); and (B021) the resistivity controller (C+32*c*+36) is made of a pressure application member move controller for holding the pressure application member at the press position when the intermediate transfer body (B) where secondary transfer has been executed in the secondary transfer area (Q4) passes through the electricity removal area (Q5), thereby applying pressure to the resistivity change layer (B2) for lowering the volume resistivity of the resistivity change layer (B2).

(Operation of Seventh Embodiment of Second Aspect of the Invention)

In the image formation system of the seventh embodiment of the second aspect of the invention comprising the configuration, the pressure application member forming the stimulation giving member (36) is supported for move between the press position where the pressure application member is pressed toward the conductive member for electricity removal from the surface of the intermediate transfer body (B) in the electricity removal area (Q5) and the distant position where the pressure application member is away from the surface of the intermediate transfer body (B).

The resistivity controller (C+32*c*+36) made of the pressure application member move controller holds the pressure application member at the press position when the intermediate transfer body (B) where secondary transfer has been executed in the secondary transfer area (Q4) passes through the electricity removal area (Q5). When the pressure application member is moved to the press position, pressure (predetermined physical stimulation) is applied to the intermediate transfer body (B). When the pressure is applied, the volume resistivity of the resistivity change layer (B2) of the intermediate transfer body (B) lowers.

Therefore, electricity of the intermediate transfer body (B) can be removed in a state in which the volume resistivity lowers, so that good electricity removal with less electricity removal unevenness can be executed.

(First Embodiment of Third Aspect of the Invention)

The intermediate transfer body (B) of the first embodiment of the third aspect of the invention comprises the following requirement (C02):

(C02) th resistivity change layer is a dielectric having volume resistivity ρ calculated according to the following expression (1) satisfying the following expression (2):

$$\rho = RS/L \quad (1)$$

$$\rho > 10^{14}\ \Omega\text{cm} \quad (2)$$

wherein R is a measurement resistance value between the surface and rear face of the resistivity change layer in a state in which light is not applied, L is the distance between the surface and rear face, and S is the area of the measurement portion.

(Operation of First Embodiment of Third Aspect of the Invention)

In the intermediate transfer body (B) of the first embodiment of the third aspect of the invention comprising the configuration, the resistivity change layer (B2) is a dielectric having volume resistivity ρ calculated according to the following expression (1) satisfying the following expression (2):

$$\rho = RS/L \quad (1)$$

$$\rho > 10^{14}\ \Omega\text{cm} \quad (2)$$

wherein R is a measurement resistance value between the surface and rear face of the resistivity change layer (B2) in a state in which light is not applied, L is the distance between the surface and rear face, and S is the area of the measurement portion.

Therefore, transfer can be executed in a state of very high volume resistivity, the state satisfying the expression (2). In this case, charges less move along the surface of the resistivity change layer (B2) of the intermediate transfer body (B), thus good transfer with toner image less scattering can be executed in the transfer area.

Electricity can be removed in a state in which the volume resistivity of the resistivity change layer (B2) lowers with light applied to the intermediate transfer body (B) in the electricity removal area (Q5). In this case, charges of the resistivity change layer (B2) of the intermediate transfer body (B) easily move, thus good electricity removal with less transfer unevenness can be executed.

(Second Embodiment of Third Aspect of the Invention)

The intermediate transfer body (B) of the second embodiment of the third aspect of the invention comprises the following requirement (C03):

(C03) a semiconductive sheet-like base material (B1) having mechanical strength being disposed on the rear face of the blocking layer (B2*a*).

(Operation of Second Embodiment of Third Aspect of the Invention)

The intermediate transfer body (B) of the second embodiment of the third aspect of the invention comprising the configuration has the semiconductive sheet-like base material (B1) having mechanical strength disposed on the rear face of the blocking layer (B2*a*). Therefore, the intermediate transfer body (B) having necessary mechanical strength can be manufactured easily. The volume resistivity of the semiconductive sheet-like base material (B1) is adjusted properly, whereby the attenuation speed of the charges of the intermediate transfer body (B) accumulated at the primary transfer time can be controlled. That is, the intermediate transfer body (B) can be prevented from being charged up or secondary transfer current can be prevented from flowing out by controlling the attenuation speed of the charges.

(Third Embodiment of Third Aspect of the Invention)

The intermediate transfer body (B) of the third embodiment of the third aspect of the invention comprises the following requirement (C04):

(C04) the sheet-like base material (B1) having volume resistivity ranging from $10^6$ to $10^{13}$ Ωcm.

(Operation of Third Embodiment of Third Aspect of the Invention)

In the intermediate transfer body (3) of the third embodiment of the third aspect of the invention comprising the configuration, the volume resistivity of the sheet-like bass material (B1) is set to $10^6$ to $10^{13}$ Ωm. In this case, the surface resistance of the sheet-like bass material (B1) is about $10^6$ to $10^{13}$ Ω/□.

If the volume resistivity falls below $10^6$ Ωcm, a current occurs along the sheet-like base material (B1) on the rear face of the belt (B) and charges flow into the belt support rolls (26–29), etc., coming in contact with the rear face of the belt (B) thus a sufficient transfer electric field cannot be applied and the toner image transfer performance from the image support (16) to the intermediate transfer body (B) is degraded.

If the volume resistivity exceeds $10^{13}$ Ωcm, electricty removal of the sheet-like base material (B1) itself becomes necessary.

Therefore, the volume resistivity of the sheet-like base material (B1) is set to the range of $10^6$ to $10^{13}$ Ωcm, whereby the need for electricty removal of the sheet-like base material (B1) itself is eliminated and good transfer can be executed.

EXAMPLES

Referring now to the accompanying drawings, there are shown examples of copiers as image formation systems of the invention, but the invention is not limited to the examples described below.

First Example

Figure 2:
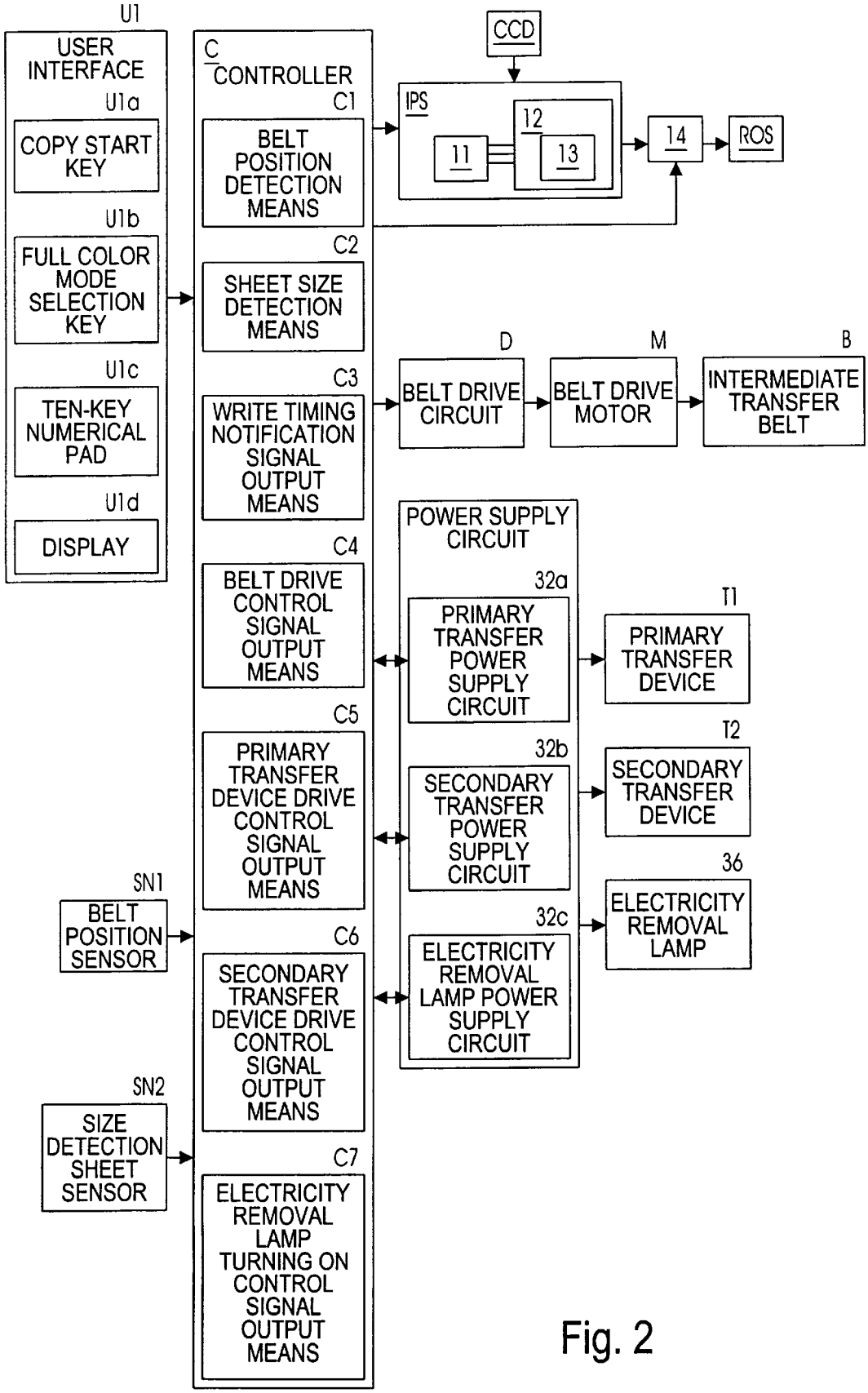
FIG. 2 is a block diagram of a control section of the first example of the invention.

FIG. 1 is a general schematic representation of a first example of an image formation system using an intermediate transfer body (B) of the invention. FIG. 2 is a block diagram of a control section of the first example of the invention.

In FIG. 1, an image formation system F has a UI (user interface) and a transparent platen glass 2 on which an original (not shown) is placed. The UI has a copy start key UIa, a full color mode selection key UIb, a ten-key numerical pad UIc, a display UId, etc., as shown in FIG. 2.

The original placed on the platen glass 2 is illuminated by a light source 4 of an original light unit 3. Original-reflected light is reflected on a first mirror 5 of the original light unit 3 and a second mirror 7 and a third mirror θ of a mirror unit 6, passes through an image formation lens 9, and is read as analog signals of R, G, and B by a CCD.

The image signals read by the CCD are input to an IPS controlled by a controller C. Image read data output means 11 of the IPS converts the input read image signals from analog form into digital form. Image data output means 12, which has an image memory 13, converts the digital data provided by the image read data output means 11 into Y, M, C, K image data, performs data processing of density correction, scaling correction, etc., and outputs the resultant data as write image data (laser drive data).

A laser drive signal output unit 14 outputs a laser drive signal of an image responsive to the image data output from the IPS to an ROS (optical scanner, namely, a latent image formation unit) at a predetermined timing. The ROS outputs a laser beam L modulated by the laser drive signal.

An image support 16 which rotates is charged by a charger 17, then an electrostatic latent image in written onto the image support 16 at a latent image write position Q1 by the laser beam L and the electrostatic latent image is developed to a toner image by a rotary developing unit 18 having K (black), Y (yellow), M (magenta), and C (cyan) color developing devices 18*k*, 18*y*, 18*m*, and 18*c* rotating together with a rotation shaft 18*a* in a developing area Q2. The developed toner image is primarily transferred to an intermediate transfer belt S by means of a primary transfer roll (primary transfer device) in a primary transfer area Q3.

Residual toner on the surface of the image support 16 passing through the primary transfer area Q3 is removed by an image support cleaner 20.

(Intermediate Transfer Belt B)

Figure 3A:
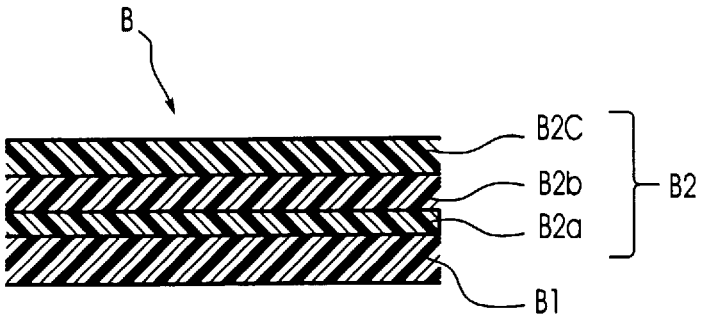
FIGS. 3A and 3B are drawings to show the cross-sectional structure of the intermediate transfer body of the first example of the invention.
Figure 3B:
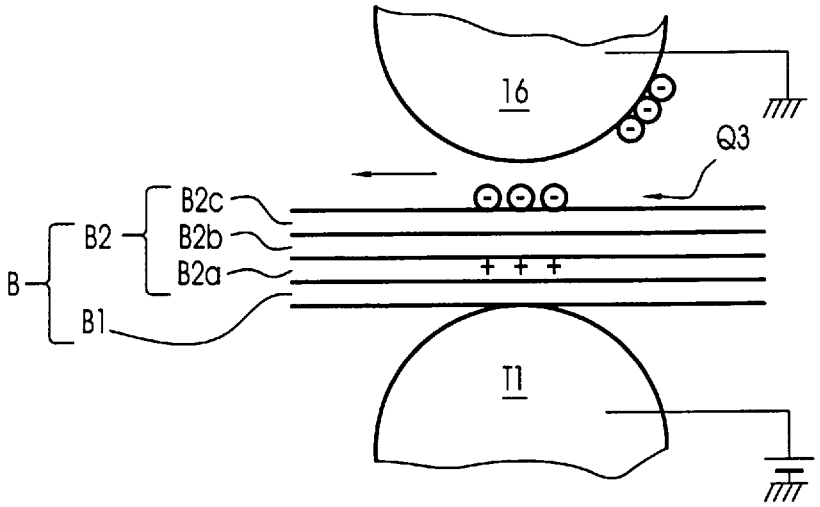

FIG. 3A and 3B &re drawings to show the cross-sectional structure of the intermediate transfer body of the first example.

In FIG. 3, the intermediate transfer belt B is of a four-layer structure of a belt base material (sheet-like base material) B1, a blocking layer B2*a*, a charge generation layer B2*b*, and a charge transport layer B2*c* which are deposited in order from the rear face to the surface. The blocking layer B2*a*, the charge generation layer B2*b*, and the charge transport layer B2*c* make up a photoconductive layer (resistivity change layer) B2.

(Belt Base Material B1)

The belt base material B1 is made of a polyimide resin to which 15% carbon black by weight is added, and is 75 $\mu$m thick. It has volume resistivity set to $10^{9.5}$ Ωcm and surface resistance set to $10^{12}$ Ω/□.

(Blocking Layer B2*a*)

The blocking layer B2*b* can be formed, for example, as follows:

Acetylacetone zirconium butoxydo (orgatics ZC540, manufactured by Matumoto Koushou) 20 parts by weight γ-aminopropyl triethoxy silane 2 parts by weight Polyvinyl butyral resin (esreck BM-S, manufactured by Sekisui kagaku (kabu)) 1.5 parts by weight n-butyl alcohol 70 parts by weight A solution consisting of these constituents is applied to the surface of the base material (B1), then is dried, and the blocking layer B2 *b*is formed 0.9 $\mu$m thick, for example.

The blocking layer B2 *b*has a function of allowing electrons of carriers of minus polarity to move, but inhibiting move of holes of carriers of plus polarity.

(Charge Generation Layer B2*b*)

The charge generation layer B2*b* is a layer 0.25 $\mu$m thick, formed of PVK (polyvinyl carbazole) to which a charge generation agent of a phthalocyanine pigment family is added. Upon application of light, the charge generation layer B2*b* generates plus and minus charges.

(Charge Transport Layer (Hole Transport Layer) B2*c*)

The charge transport layer B2*c* is a layer 25 $\mu$m thick, made of a polycarbonate resin to which a charge transport agent of a triphenyl amine family is added. The charge transport layer B2*c* has a function of allowing holes of carriers of plus polarity, but inhibiting move of electrons of carriers of minus polarity. That is, the charge transport layer B2*c* of the first example is a hole transport layer.

In FIG. 1, the intermediate transfer belt B is supported by belt support rolls 26–29 of a drive roll 26, a tension roll 27, a plurality of idler rolls 28*a*–28*c*, and an inner secondary transfer roll (backup roll) 29 for rotation. The idler roll 28*a* is made of a grounded metal roll and in used as a conductive roll 28*a* for removing electricity (charges).

(Secondary Transfer Device T2)

A secondary transfer device T2 is made up of the inner secondary transfer roll 29, an outer secondary transfer roll 30 placed between a distant position from the inner secondary transfer roll 29 and a near position at which the outer secondary transfer roll 30 is pressed against the inner secondary transfer roll 29 so that the outer secondary transfer roll 30 can be moved away from and toward the inner secondary transfer roll 29, and an electrode roll 31 made of metal abutting the inner secondary transfer roll 29. The inner secondary transfer roll 29 comprises a semiconductive elastic body wound around a conductive metal roll and has surface resistivity adjusted to $1\times10^{7}$ 106 /□ or more, for example.

The grounded outer secondary transfer roll 30 comprises a metal roll whose surface is wrapped in carbon-dispersion expanded urethane, the outside of which is covered with a semiconductive thin film. It has volume resistively adjusted to $10^{8}$ Ωcm, for example.

Applied voltages to the primary transfer roll (primary transfer device) T1 and the electrode roll 31 of the secondary transfer device T2 are supplied from a primary transfer power supply circuit 32*a* and a secondary transfer power supply circuit 32*b* of a power supply circuit 32 (see FIG. 2).

The secondary transfer device T2 secondarily transfers the toner images primarily transferred onto the intermediate transfer belt B in overlapped relation to a transfer material S passing through a secondary transfer area Q4 formed in a nip (contact area) between the outer secondary transfer roll 30 and the intermediate transfer belt B.

Toner deposited on the surface of the outer secondary transfer roll 30 is removed by a secondary transfer roll cleaner 33. A belt cleaner 34 is placed downstream from the secondary transfer area Q4 along the surface of the intermediate transfer belt B.

The outer secondary transfer roll 30 and the belt cleaner 34 are disposed so that they can be moved toward and away from and brought into contact with the intermediate transfer belt B. To form a color image, they are away from the intermediate transfer belt B until an unfixed toner image of the last color is primarily transferred to the intermediate transfer belt B.

(Electricity Removal Lamp (Stimulation Giving Member) 36)

The electricity removal roll 28*a* is conductive and is grounded. An electricity removal lamp (stimulation giving member) 36 is disposed at a position facing the electricity removal roll 28*a* with the intermediate transfer belt B between. An electricity removal area Q5 is formed between the electricity removal lamp 36 and the electricity removal roll 28*a*.

Electricity removal voltage applied to the electricity removal lamp 36 is supplied from an electricity removal lamp power supply circuit 32*c* of the power supply circuit 32 (see FIG. 2).

A belt position sensor SN1 (see FIG. 2) is provided for detecting a mark MK (see FIG. 1) to detect a position of the intermediate transfer belt B. The latent image write timing onto the image support 16 is controlled by a position detection signal of the intermediate transfer belt B with high accuracy output from the belt position sensor SN1.

The transfer material S stored in a paper feed tray 41 is taken out by a pickup roll 42, is separated one sheet at a time by a handling roller 43, is once stopped at a registration roll 44, and is transported from a guide transport passage 45 to the secondary transfer area Q4 at a predetermined timing. The transfer material S to which the toner image is secondarily transferred when the transfer material S passed through the secondary transfer area Q4 is transported through a sheet guide 46 and on a sheet transfer belt 47 to a fixing area Q6. When the transfer material S passes through the fixing area Q6, the secondarily transferred toner image onto the transfer material S is fixed by a pair of fixing rolls of a fuser 48 and the transfer material S is discharged to a paper discharge tray 49.

The components 41 to 47 make up a transfer material transporter (42–47).

(Description of Control Section of First Example)

FIG. 2 is a block diagram of the control section of the first example.

The UI (user interface) is connected to the controller C. The UI has the job start key (copy start key) UIa, the full color mode selection key UIb, the ton-key numerical pad UIc, the display UId, etc., as described above.

Detection signals of the following sensors are input to the controller C:

SN1: Belt position sensor

The belt position sensor SN1 (see FIGS. 1 and 2) detects a mark put on the intermediate transfer belt B and outputs a detection signal to the controller C.

SN2: Size detection sheet sensor

A size detection sheet sensor SN2 in a sensor for sensing whether or not a sheet of paper passes through and detecting the paper size (sheet size). The sensor outputs a detection signal to the controller C.

Detection signals of a paper discharge sensor (not shown), a fuser temperature sensor (not shown), and other sensors (not shown) are input to the controller C.

The control C to which signals are input from the UI (user interface) and the sensors SN1, SN2, etc., outputs an operation timing control signal of the IPS, an operation timing control signal of the laser drive signal output unit 14, operation signals of a belt drive circuit D for driving a motor M for turning the intermediate transfer belt B, the primary transfer power supply circuit 32*a*, the secondary transfer power supply circuit 32*b*, and the electricity removal lamp power supply circuit 32*c* of a power supply circuit 32, and the like.

The controller C for executing processing responsive to the various input signals is made of a computer having an I/O (input-output interface) for inputting/outputting signals from/to the outside and adjusting the input/output signal level, ROM (read-only memory) storing programs, data, etc., required for performing processing, RAM (random access memory) for temporarily storing necessary data, a CPU (central processing unit) for performing input/output control, operation processing, etc., responsive to the programs stored in the ROM, and the like. The controller C can provide various functions by executing the programs stored in the ROM.

That is, the controller C has the following functions:

C1: Belt position detection means

Belt position detection means C1 measures the elapsed time since the time at which the belt position sensor SN1 detected the belt mark MK, thereby detecting the rotation position of the intermediate transfer belt B.

C2: Sheet size detection means

Sheet size detection means C2 detects the sheet size in the sheet (paper) transport direction based on the passage times of the leading and trailing ends of a sheet (paper) detected by the size detection sheet sensor SN2.

C3: Write timing notification signal output means

Write timing notification signal output means C3 outputs a write timing notification signal to the IPS and the laser drive signal output unit 14 based on a belt mark detection signal of the belt position sensor SN1.

That is, since the toner image transfer start position on the intermediate transfer belt B arrives at the primary transfer area Q3 in a predetermined time after the belt position sensor SN1 detects the belt mark, it is necessary to make the leading end of a toner image formed on the image support 16 arrive at the primary transfer area Q3 matching the timing. To do this, image write to the latent image write position Q1 by the ROS needs to be started at a predetermined timing. Thus, the write timing notification signal output means C3 outputs the write timing notification signal.

The IPS and the laser drive signal output unit 14 output a laser drive signal from the laser drive signal output unit 14 to the ROS at a predetermined timing since output of the write timing notification signal.

C4: Belt drive control signal output means

Belt drive control signal output means C4 outputs a control signal of the belt drive circuit D of the belt drive motor M for turning the intermediate transfer belt B.

C5: Primary transfer device drive control signal output means

Primary transfer device drive control signal output means C5 applies a given primary transfer current or voltage to the primary transfer device T1 when an image formation area of the intermediate transfer belt B passes through the primary transfer area Q3.

C6: Secondary transfer device drive control signal output means

Secondary transfer device drive control signal output means C6 applies a given secondary transfer current or voltage to the secondary transfer device T2 when the image formation area of the intermediate transfer belt B passes through the secondary transfer area Q4 and secondary transfer is executed.

C7: Electricity removal lamp turning on control signal output means

Electricity removal lamp turning on control signal output means C7 outputs an electricity removal lamp turning on control signal to the electricity removal lamp power supply circuit 32*c* (see FIG. 2) so as to turn on the electricity removal lamp when the secondary transfer execution portion of the secondary transfer belt B passes through an electricity removal area.

The controller C having the electricity removal lamp turning on control signal output means C7 and the electricity removal lamp power supply circuit 32*c* make up a light source control circuit (C+32*c*). The controller C having the electricity removal lamp turning on control signal output means C7, the electricity removal lamp power supply circuit 32*c*, and the electricity removal lamp 36 make up a resistively controller (C+32*c*+36).

(Operation of First Example)

In FIG. 1, in the first example of the image formation system having the configuration described above, the write timing notification signal output means C3 of the controller C outputs a write timing notification signal to the IPS and the laser drive signal output unit 14 based on a belt mark detection signal of the belt position sensor SN1.

That is, since the toner image transfer start position on the intermediate transfer belt B arrives at the primary transfer area Q3 in a predetermined time after the belt position sensor SN1 detects the belt mark MK, it is necessary to make the leading end of a toner image formed on the image support 16 arrive at the primary transfer area Q3 matching the timing. To do this, image write to the latent image write position Q1 by the ROS needs to be started at a predetermined timing. Thus, the write timing notification signal output means C3 outputs the write timing notification signal.

The IPS and the laser drive signal output unit 14 output a laser drive signal from the laser drive signal output unit 14 to the ROS at a predetermined timing since output of the write timing notification signal.

The ROS operating based on the laser drive signal writes an electrostatic latent image onto the image support 16 at a predetermined timing (at which the toner image of each color is transferred to the image area on the intermediate transfer belt B in overlapped relation). The electrostatic latent images of colors formed on the image support 16 are developed to toner images in order by the X (black), Y (yellow), M (magenta), and C (cyan) color developing devices 18*k*, 18*y*, 18*m*, and 18*c* of the rotary. developing unit 18.

The unfixed toner images T formed in order on the image support 16 (see FIG. 1) are transferred from the image support 16 to the surface of the intermediate transfer belt B in order in overlapped relation in the primary transfer area Q3 where the image support 16 and the intermediate transfer belt B come in contact with each other in order.

When a voltage of the opposite polarity to the toner charge polarity is applied to the primary transfer device T1 disposed on the rear face of the intermediate transfer belt B in the primary transfer area Q3, an electric field is produced between the primary transfer device T1 and the image support 16, thus the unfixed toner image T on the image support 16 is electrostatically attracted onto the intermediate transfer belt B.

The primary transfer power supply circuit 32*a* operating based on a control signal of the primary transfer device drive control signal output means C5 of the controller C applies a primary transfer constant current to the primary transfer device T1 when the image transfer area of the intermediate transfer belt B passes through the primary transfer area Q3.

The remaining toner on the image support 16 after the primary transfer is cleaned by the image support cleaner 20 of the image support 16 before the next cycle.

To form a single-color image, the unfixed toner image T primarily transferred to the intermediate transfer belt B is immediately secondarily transferred to a recording sheet (transfer material) S. To form a color image comprising toner images of different colors overlapped, formation of a toner image on the image support 16 and primary transfer of the toner image are repeated as many times as the number of colors.

For example, to form a full color image comprising toner images of four colors overlapped, unfixed toner images T of black, yellow, magenta, and cyan are formed on the image support 16 in order each time the image support 16 makes one turn, and the unfixed toner images T are primarily transferred to the intermediate transfer belt B in order.

On the other hand, the intermediate transfer belt B turns at the same circumferential speed as the image support 16 while it holds the unfixed toner image T of the first color (for example, black) first primarily transferred, and each time the intermediate transfer belt B makes one turn, the unfixed toner images T of yellow, magenta, and cyan are transferred in order to the black unfixed toner image T in overlapped relation on the intermediate transfer belt B.

The unfixed toner image T thus primarily transferred to the intermediate transfer belt B are transported to the secondary transfer area Q4 facing the recording sheet transport passage as the intermediate transfer belt B turns. In the secondary transfer area Q4, the semiconductive outer secondary transfer roll 30 is in contact with the intermediate transfer belt B. Recording sheet S transported from the tray 41 by the pickup roller 42 at a predetermined timing is separated one sheet at a time by the handling roll 43 and is once stopped at the registration roll 44, then is transported from the guide transport passage 45 to the secondary transfer area Q4 at a predetermined timing.

When a DC voltage of the same polarity as the toner charge polarity is applied to the electrode roll 31 by the secondary transfer power supply, circuit 32*b* (see FIG. 2), the unfixed toner images T supported on the intermediate transfer belt B are electrostatically transferred to the recording sheet S in the secondary transfer area Q4.

The recording sheet S to which the unfixed toner images T are transferred is stripped off from the intermediate transfer belt B and is transported to the fixing area Q6 and the unfixed toner images T are fixed by the fuser 48. On the other hand, the residual toner on the intermediate transfer belt B completing the secondary transfer of the unfixed toner images T is removed by the belt cleaner 35.

When the intermediate transfer belt B completing the secondary transfer passes through the electricity removal area Q5, it is irradiated with light by the electricity removal lamp 36. Charges occur on the charge generation layer B2*b* by irradiation with light and the charge transport layer B2*c* becomes conductive, then electricity is removed.

Figure 4A:
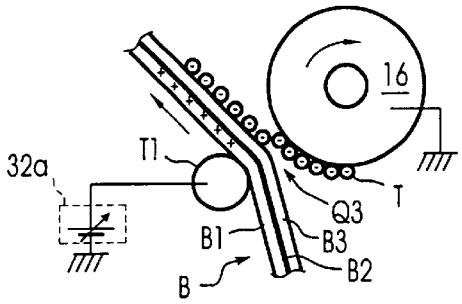
FIGS. 4A to 4E are schematic representations of the transfer operation and electricity removal operation of the image formation system.
Figure 4B:
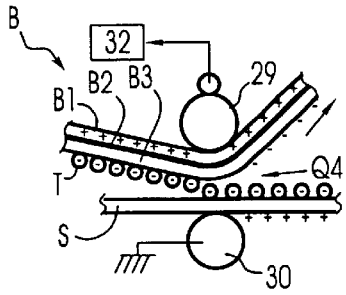
Figure 4C:
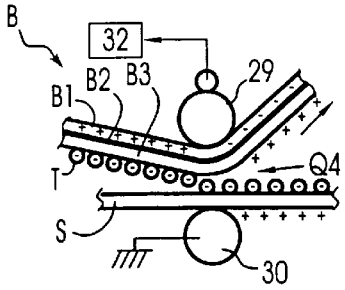
Figure 4D:
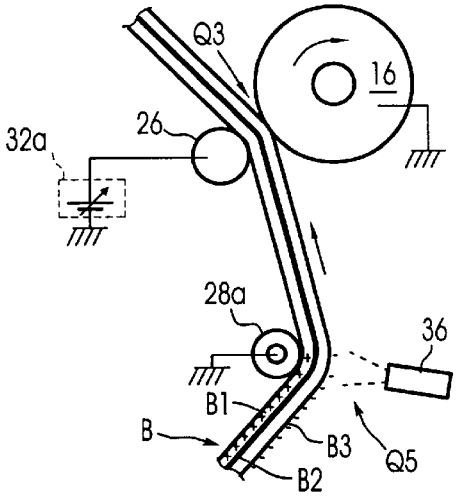
Figure 4E:
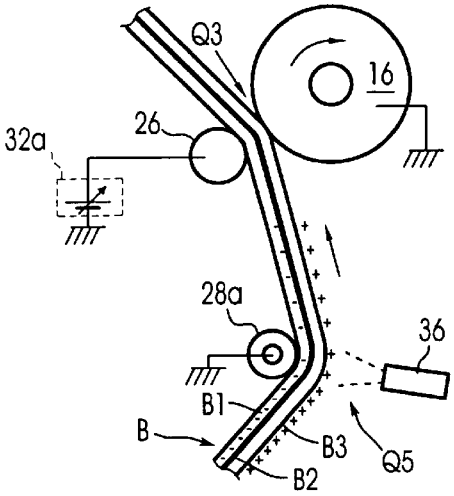

FIGS. 4A to 4E are schematic representations of the transfer operation and electricity removal operation of the image formation system. FIG. 4A is a schematic representation of the transfer operation in primary area; FIG. 4B is a schematic representation to show charges on the intermediate transfer belt B after secondary transfer when secondary transfer voltage is low; FIG. 4C is a schematic representation to show charges on the intermediate transfer belt B after secondary transfer when secondary transfer voltage is high; FIG. 4D is a schematic representation to show charges on the intermediate transfer belt B after electricity removal when secondary transfer voltage is low; and FIG. 4E is a schematic representation to show charges on the intermediate transfer belt B after electricity removal when secondary transfer voltage is high.

Figure 5:
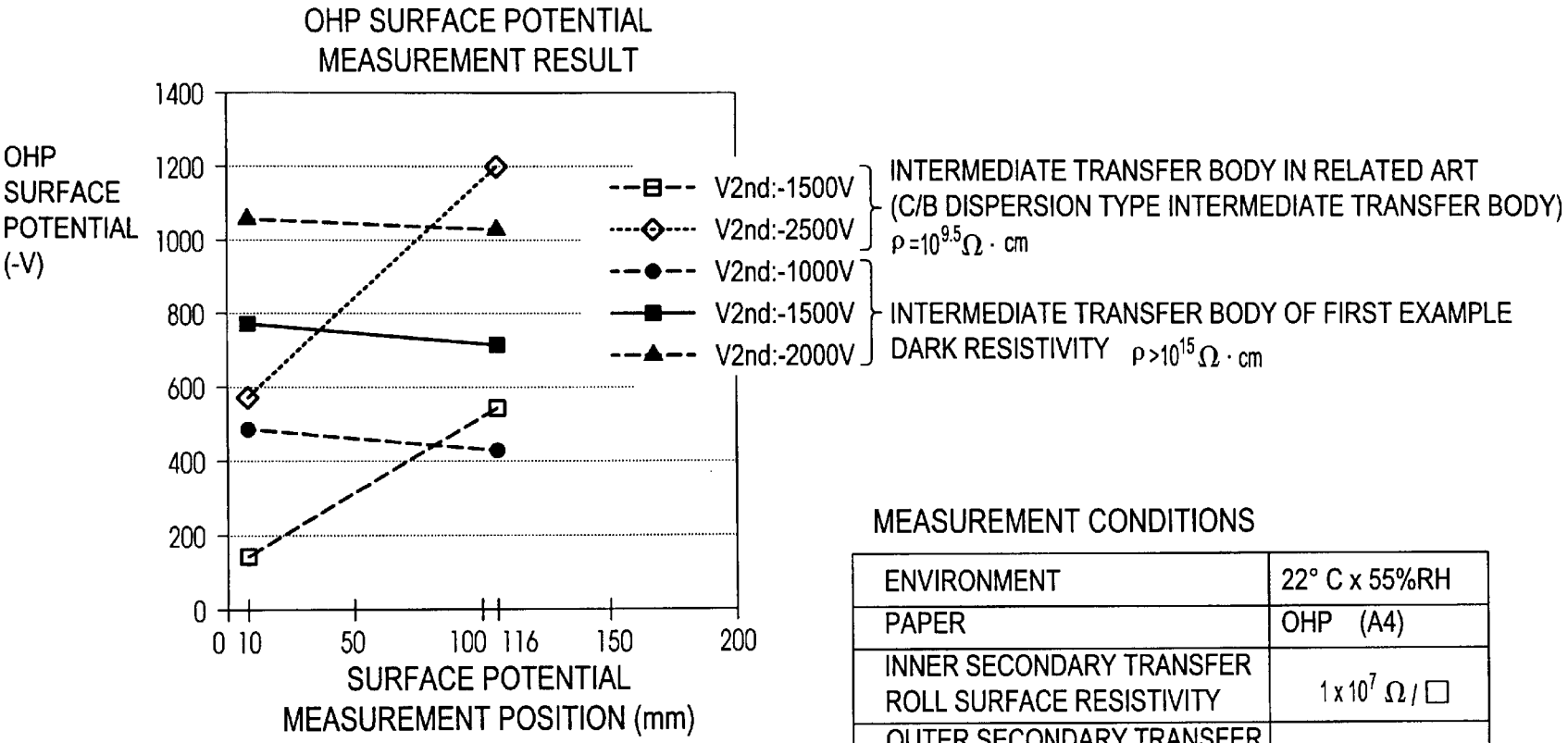
FIG. 5 is a graph to show the relationship between the surface potentials of center and outer peripheral portions of OHP paper having high volume resistivity and the volume resistivities of intermediate transfer belts when the OHP paper passes through secondary transfer area.

FIG. 5 is a graph to show the relationship between the surface potentials of center and outer peripheral portions of OHP paper having high volume resistivity and the volume resistivities of intermediate transfer belts when the OHP paper passes through secondary transfer area.

FIG. 6 is a table to show the relationship between the surface potentials of center and outer peripheral portions of OHP paper having high volume resistivity and the volume resistivities of intermediate transfer belts when the OHP paper passes through secondary transfer area.

In FIG. 4A, when the toner image on the image support 16 is transferred to the intermediate transfer belt B in the primary transfer area Q3 by applying a primary transfer voltage to the primary transfer device T1, plus charges accumulate on the rear face of the intermediate transfer belt B and minus-charged toner is deposited on the surface of the intermediate transfer belt B.

When the intermediate transfer belt B passes through the primary transfer area and turns, if the volume resistivity of the intermediate transfer belt B is low, even if charges are given from the primary transfer device T1 an described above, they are electrically neutralized in an instant because of self-discharging, thus a potential difference (voltage) does not occur between the surface and rear face of the intermediate transfer belt B. Therefore, the value of the voltage or current applied to the primary transfer device T1 in the transfer cycle of the first color becomes the same as that in the later transfer cycle.

However, if the volume resistivity of the intermediate transfer belt B is low, when OHP paper having high volume resistivity is used, a sufficient transfer electric filed is not applied to the outer peripheral portion of the OHP paper, as shown in FIGS. 5 and 6.

FIGS. 5 and 6 show measurement values of the surface potentials of OHP sheet after passing through the secondary transfer area using intermediate transfer belt (IBT) B (volume resistivity $\rho=10^{9.5}$ Ωcm) in related art and the intermediate transfer belt (IBT) of the first example.

As seen in FIGS. 5 and 6, to use the intermediate transfer belt B in the related art having low volume resistivity, the surface potentials in the outer peripheral and center portions of OHP paper after passing through the secondary transfer area Q4 are largely different, but to use the intermediate transfer belt B of the first example having high volume resistivity, the surface potentials in the outer peripheral and center portions of OHP paper after passing through the secondary transfer area Q4 are almost the same.

The possible reason is as follows:

In the secondary transfer area Q4 where secondary transfer is executed in the image formation system, secondary transfer is executed in a state in which the intermediate transfer belt B is sandwiched between the inner secondary transfer roll 29 placed on the rear face side and the outer secondary transfer roll 30 placed on the surface side. At the secondary transfer time, a transfer material S such as a recording sheet is sandwiched between the intermediate transfer belt B and the outer secondary transfer roll 30. Since the transfer material S is narrower than the intermediate transfer belt B and the outer secondary transfer roll 30, in the portion outside the transfer material S, the transfer material 5 is not sandwiched and the intermediate transfer belt B and the outer secondary transfer roll 30 come in direct contact with each other. If the volume resistivity of the intermediate transfer belt B is small as compared with that of the transfer material S, much current flows into the direct contact portion between the intermediate transfer belt B and the outer secondary transfer roll 30.

In this case, it is considered that the surface potential difference occurs because the transfer electric field applied to the outer peripheral position of the transfer material S is small as compared with that applied to the center portion. At this time, necessary transfer electric field may not be provided in the outer peripheral position of the transfer material S.

Therefore, it is desired that the volume resistivity of the intermediate transfer belt B is almost equal to or more than that of the transfer material S such as a recording sheet.

However, if the volume resistivity of the intermediate transfer belt B is high, each time the intermediate transfer belt B passes through the primary transfer device T1, the charges on the intermediate transfer belt B increase because charges are given from the primary transfer device T1, and the charge potential of the intermediate transfer belt B rises.

That is, a potential difference (voltage) occurs between the surface and rear face of the intermediate transfer belt B because of the charges. To primarily transfer toner images of the second to fourth colors to the charged intermediate transfer belt B in overlapped relation, it is necessary to apply a primary transfer voltage equal to or greater than the potential difference between the surface and rear face. Therefore, a difference occurs between the value of the voltage or current applied to the primary transfer device T1 in the transfer cycle of the first color and that applied to the primary transfer device T1 in the transfer cycle of the fourth color, for example.

Figure 7:
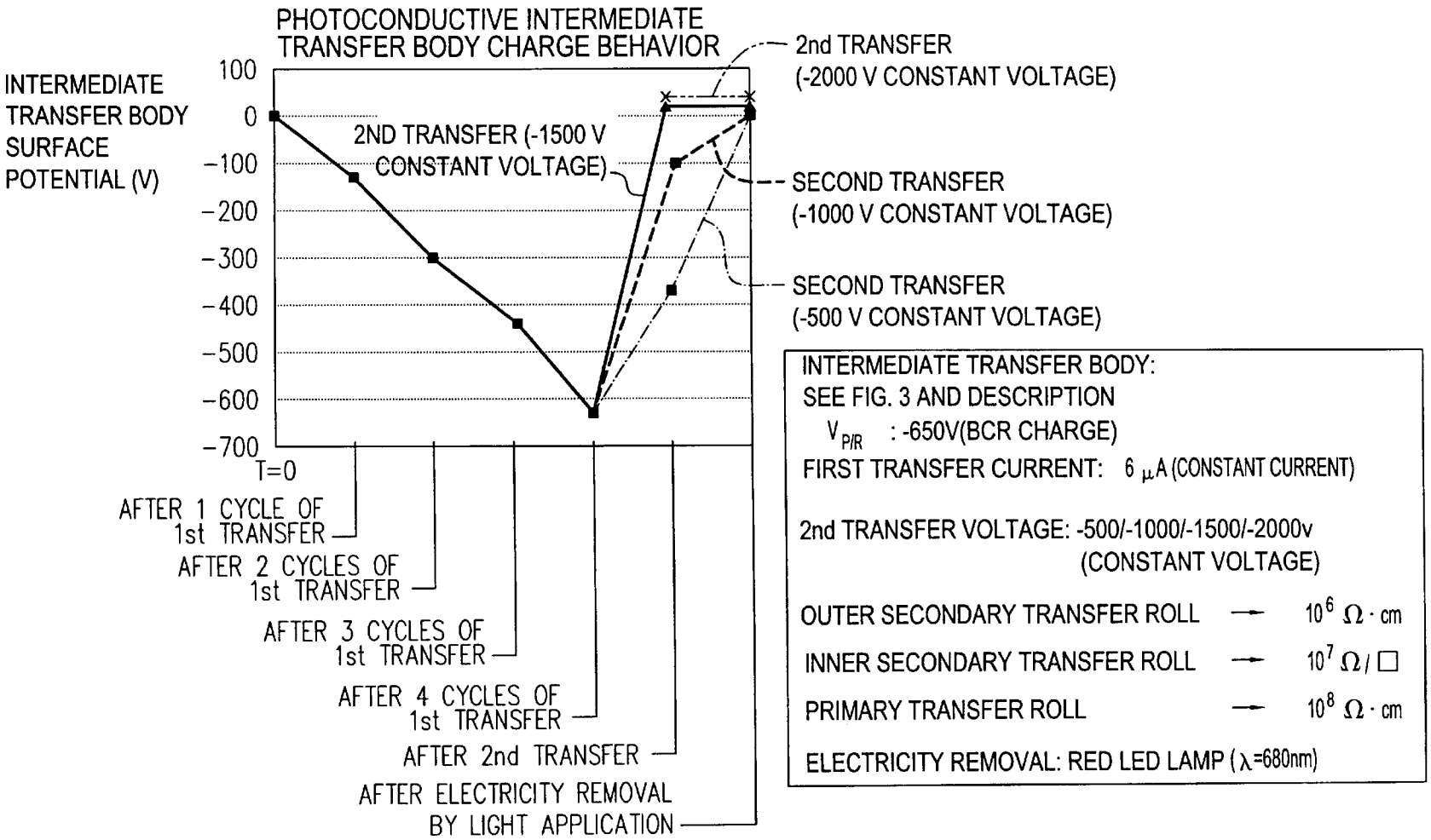
FIG. 7 is a graph to show surface charge potentials of the intermediate transfer belt B after primary transfer of toner images of first to fourth colors at the full color image formation time, after secondary transfer after the primary transfer of the tonr image of the fourth color, and after electricity removal by light application after the secondary transfer.

FIG. 7 is a graph to show surface charge potentials of the intermediate transfer belt B after primary transfer of toner images of first to fourth colors at the full color image formation time, after secondary transfer after the primary transfer of the toner image of the fourth color, and after electricity removal by light application after the secondary transfer.

FIG. 8 is a table to show surface charge potentials of the intermediate transfer belt B after primary transfer of toner images of first to fourth colors at the full color image formation time, after secondary transfer after the primary transfer of the toner image of the fourth color, and after electricity removal by light application after the secondary transfer.

The graph of FIG. 7 and the table of FIG. 8 show the charge potentials of the intermediate transfer belt B when the intermediate transfer belt B in FIG. 3 is used with the image formation system in FIG. 1, the surface charge potential of the image support 16 by the charger 17 (see FIG. 1), Vp/r, is set to −650 V, constant current transfer of 6 μA in always executed at the primary transfer time of toner images of first to fourth colors, and constant voltage transfer is executed at a voltage of −500 V, −1000 V, −1500 V, or −2000 V as secondary transfer.

As seen in FIGS. 7 and 8, the surface potential of the intermediate transfer belt B after the secondary transfer varies depending on the value of the secondary transfer voltage. When the absolute value of the secondary transfer voltage is low (−500 V or −1000 V), the surface potential is minus; when the absolute value of the secondary transfer voltage is high (−1500 V or −2000 V), the surface potential becomes plus.

(When intermediate transfer belt B surface in minus-charged and intermediate transfer belt B passes through electricity removal area)

In FIGS. 4B and 4D to show charges after secondary transfer of the intermediate transfer belt B when the secondary transfer voltage is low and after electricity removal, when the intermediate transfer belt B passes through the electricity removal area Q5 with the intermediate transfer belt B surface minus-charged after secondary transfer, plus and minus charges occur on the charge generation layers B2*b* as the electricity removal lamp 36 is turned on. The plus charges occurring are moved to the belt surface by means of the hole transport layer B2*c*, canceling the minus charges on the belt surface. The minus charges occurring flow into the grounded electricity removal roll 28*a* through the blocking layer B2*a* allowing the minus charges to move. Therefore, in the first example, if the intermediate transfer belt B surface is minus-charged in the electricity removal area Q5, electricity can be removed.

(When intermediate transfer belt B surface is plus-charged and intermediate transfer belt B passes through electricity removal area)

In FIGS. 4C and 4E to show charges after secondary transfer of the intermediate transfer belt B when the secondary transfer voltage is high and after electricity removal, when the intermediate transfer belt B passes through the electricity removal area Q5 with the intermediate transfer belt B surface plus-charged after secondary transfer, plus and minus charges occur on the charge generation layers B2*b* as the electricity removal lamp 36 is turned on. The minus charges occurring flow into the grounded electricity removal roll 28*a* through the blocking layer B2*a* allowing the minus charges to move. That is, the minus charges occurring are not used to cancel the plus charges on the intermediate transfer belt B surface and flow into the grounded electricity removal roll 28*a*. Thus, in the first example, if the surface of the intermediate transfer belt B passing through the electricity removal area Q5 after secondary transfer, electricity cannot be removed.

Therefore, if the charge transport layer B2*c* is a hole transport layer allowing plus charges to move and the blocking layer B2*a* is an electron transport layer allowing minus charges to move, it is necessary to set secondary transfer voltage so that the charge potential on the surface of the photoconductive layer B2 after second transfer becomes minus.

The described color image formation system can execute primary transfer and secondary transfer with toner less scattering in a state in which the volume resistivity of the intermediate transfer belt B is high, and can execute good electricity removal in a state in which the volume resistivity of the intermediate transfer belt B is low.

Figure 9:
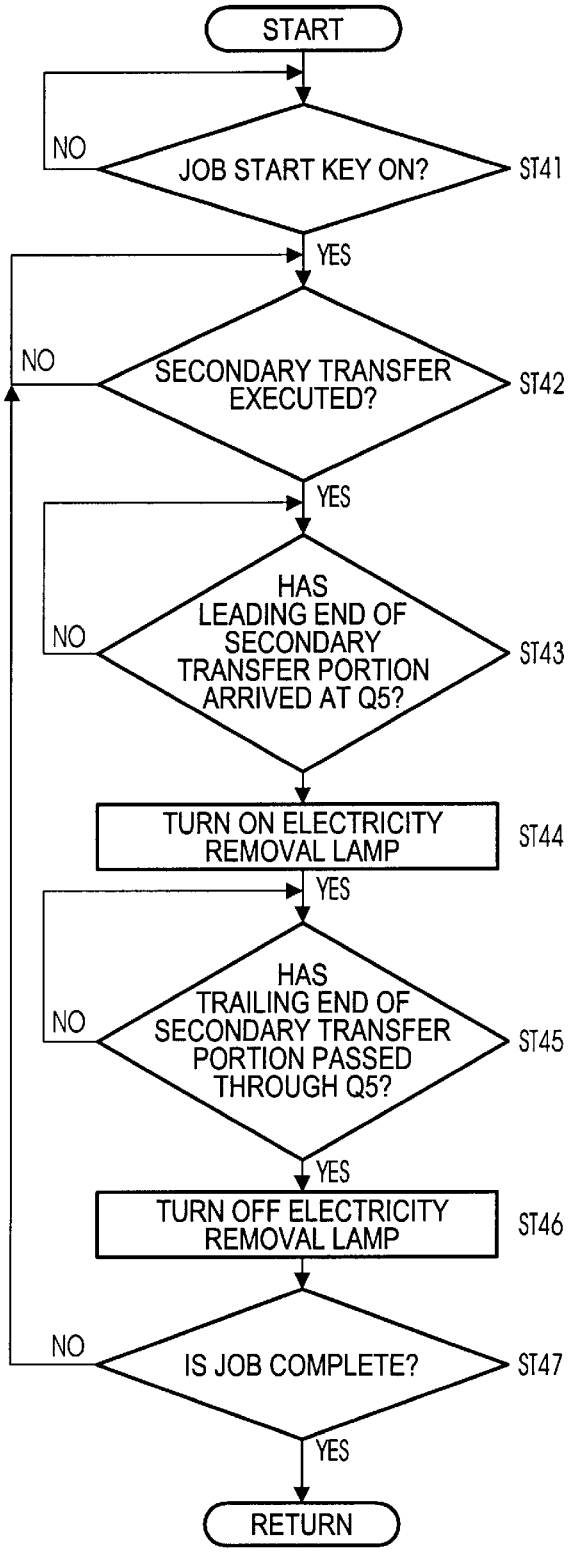
FIG. 9 is an electricity removal lamp turning on control flowchart.
Figure 10:
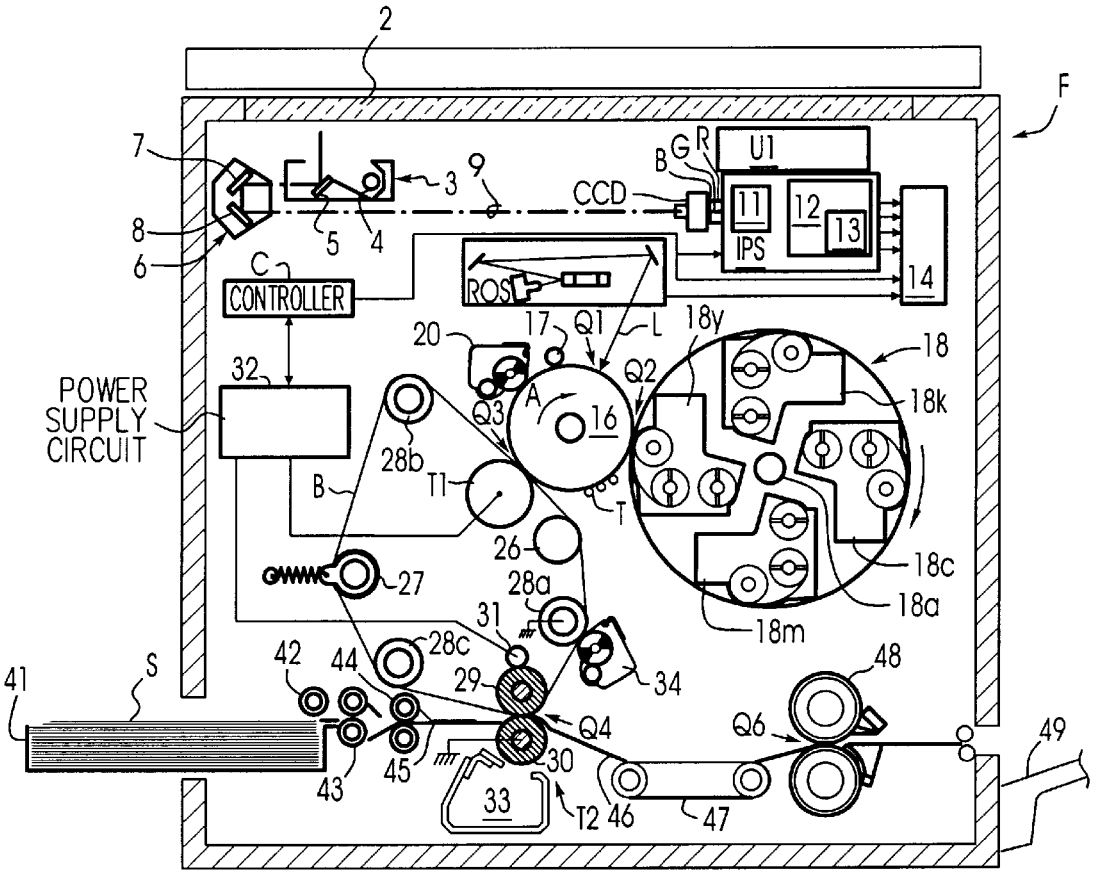
FIG. 10 is a schematic representation of an image formation system in a related art using an intermediate transfer body incorporating the invention.
Figure 11A:
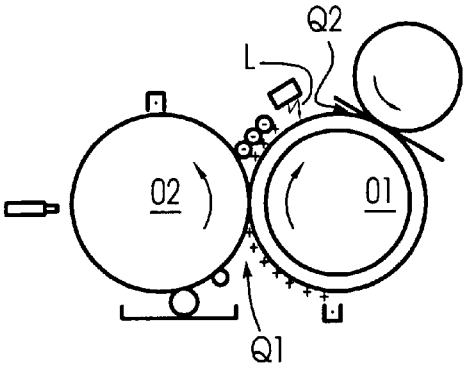
FIGS. 11A to 11F are schematic representations of an art described in the Unexamined Japanese Patent Application Publication No. Hei 7-146616.
Figure 11B:
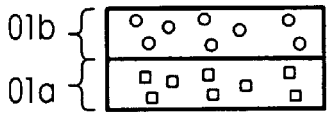
Figure 11C:
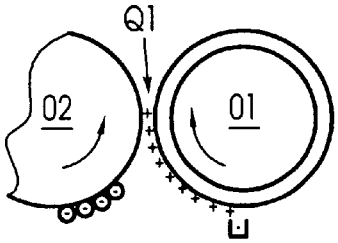
Figure 11D:
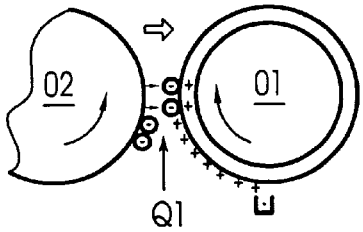
Figure 11E:
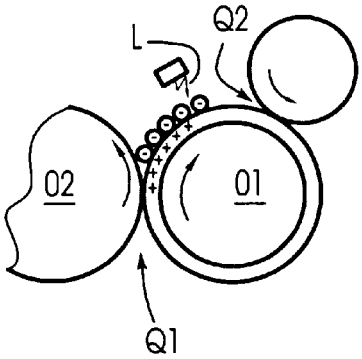
Figure 11F:
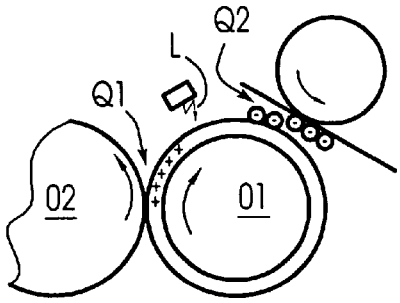
Figure 12A:
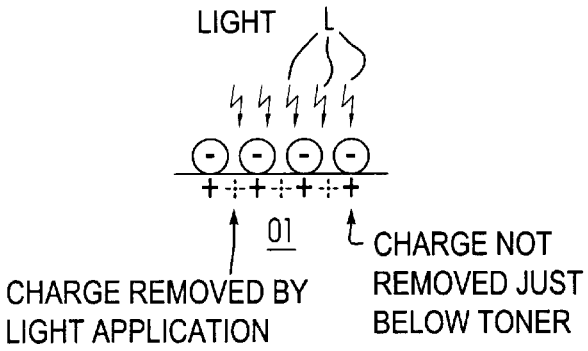
FIGS. 12A to 12D are schematic representations of a problem arising when the art described in the Unexamined Japanese Patent Application Publication No. 7-146616 is applied to a multiple transfer system of color image in different color toners.
Figure 12B:
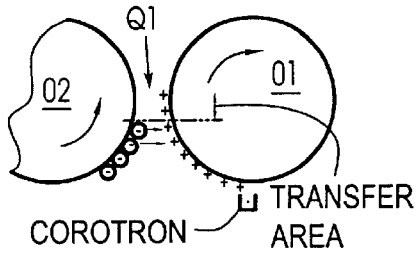
Figure 12C:
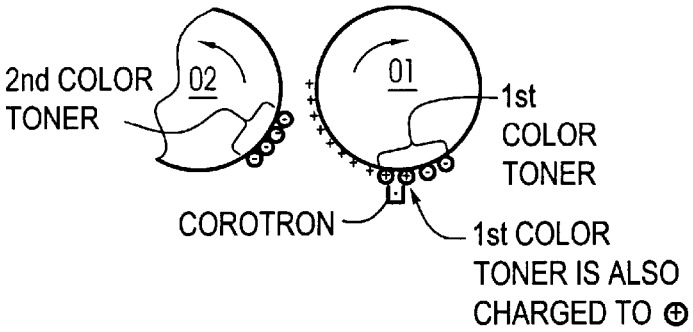
Figure 12D:
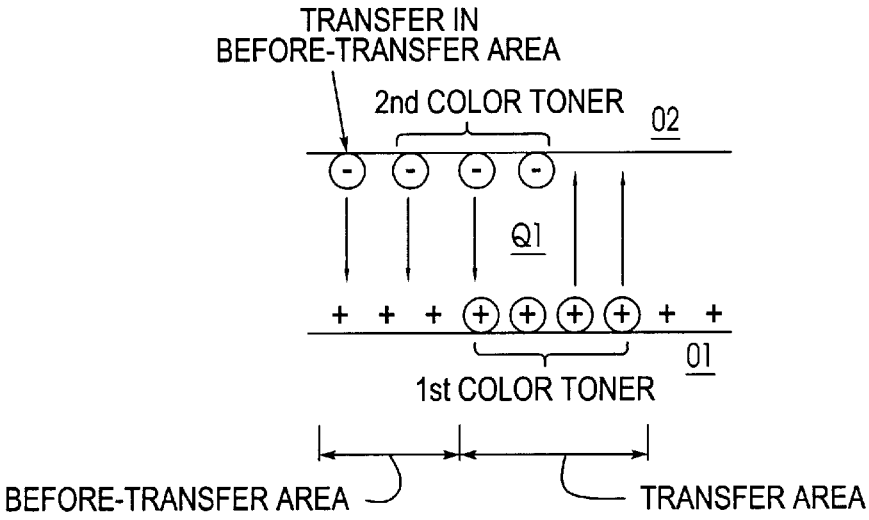
Figure 13A:
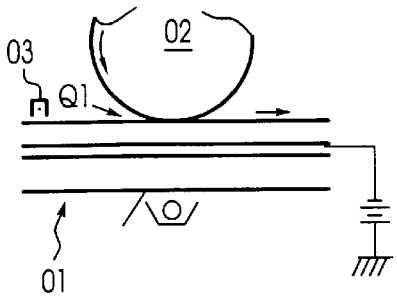
FIGS. 13A to 13D are schematic representations of an art described in the Unexamined Japanese Patent Application Publication No. Hei 5-257398.
Figure 13B:
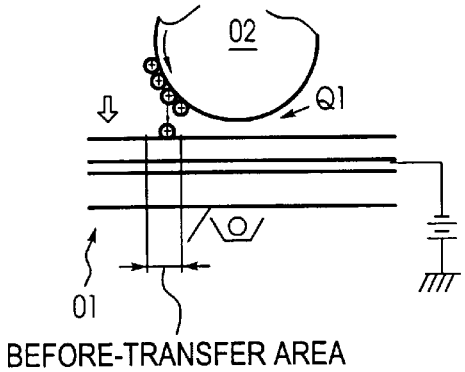
Figure 13C:
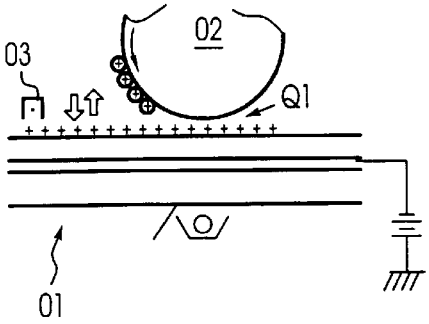
Figure 13D:
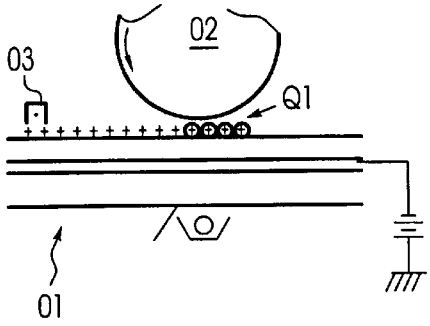
Figure 14A:
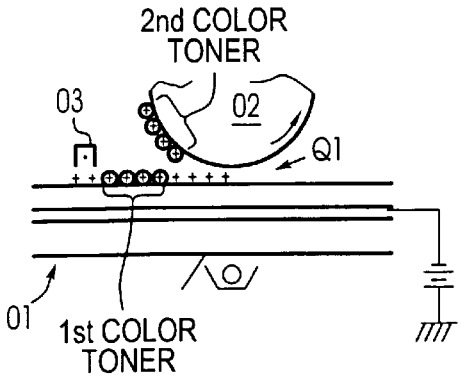
FIGS. 14A and 14B are schematic representations of a problem arising when a developed image of the second color is transferred by the art described in the Unexamined Japanese Patent Application Publication No. Hei 5-257398.
Figure 14B:
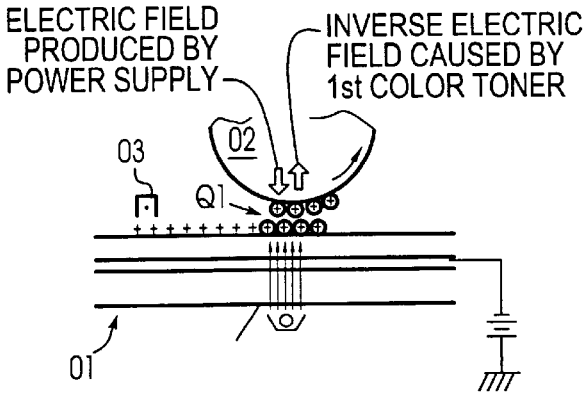
Figure 15A:
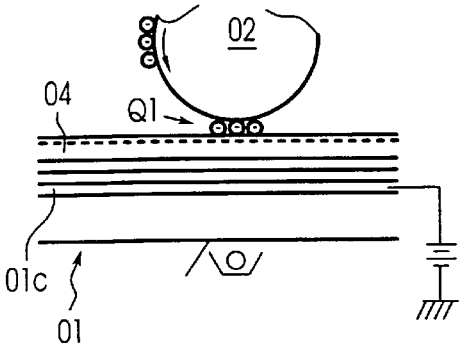
FIGS. 15A and 15B are schematic representations of an art using an intermediate transfer body whose resistance value lowers by light application and applying light for executing transfer, described in the Unexamined Japanese Patent Application Publication No. Hei 6-282181.
Figure 15B:
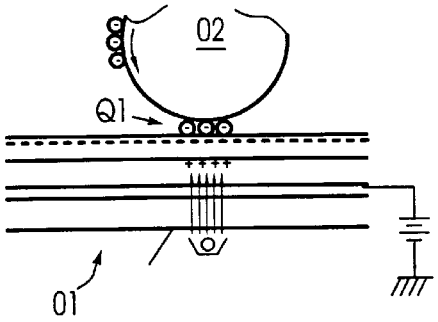
Figure 16A:
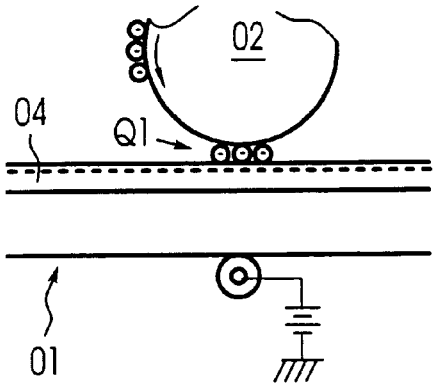
FIGS. 16A and 16B are schematic representations of an art using an intermediate transfer body whose resistance value lowers by applying pressure and applying pressure for executing transfer, described in the Unexamined Japanese Patent Application Publication No. Hei 6-282181.
Figure 16B:
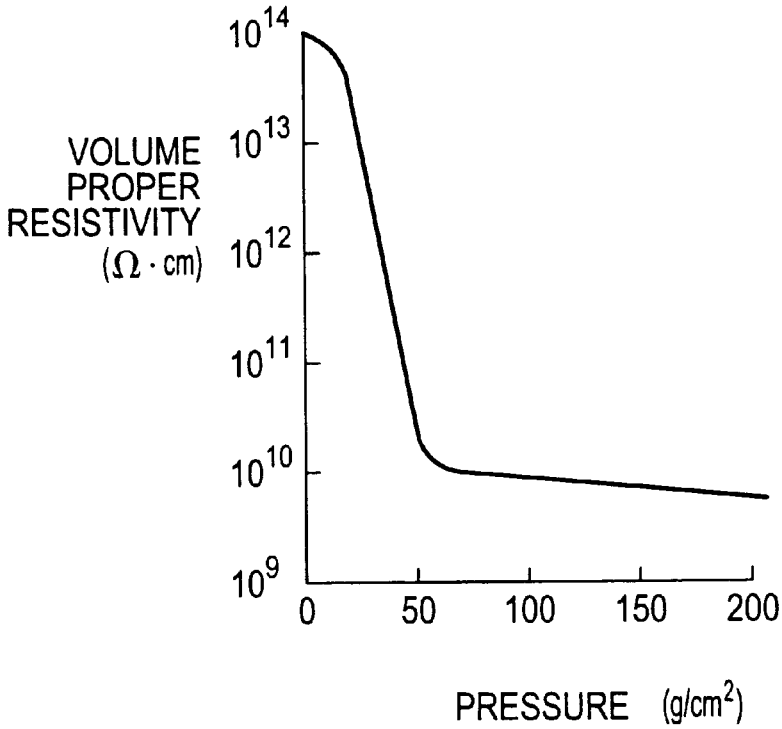

FIG. 9 is an electricity removal lamp turning on control flowchart.

The steps of the flowchart of FIG. 9 are executed according to a program stored in ROM of the controller C (see FIG. 2) made of the computer. The steps of the flowchart are executed as multitasking in parallel with any other processing (not shown).

(Electricity Removal Lamp Turning on Control Flow)

In the electricity removal lamp turning on control flow shown in FIG. 9, whether or not the job start key (copy start key) for starting a job of the image formation system is turned on is determined at step ST41. If the job start key is not turned on, step ST41 is repeated. It the job start key is turned on, control goes to step ST42.

At step ST42, whether or not secondary transfer has been executed is determined. If secondary transfer has not yet been executed, step ST42 is repeated. It secondary transfer has been executed, control goes to step ST43.

At step ST43, whether or not the leading end of the secondary transfer portion of the intermediate transfer belt B (image area) has arrived at the electricity removal area Q5 is determined. If the leading end has not yet arrived at the electricity removal area Q5, step ST43 is repeated. It the leading end has arrived at the electricity removal area Q5, control goes to step ST44.

At step ST44, the electricity removal lamp 36 is turned on.

Next, at step ST45, whether or not the trailing and of the secondary transfer portion of the intermediate transfer belt B (image area) has passed through the electricity removal area Q5 is determined. If the trailing end has not yet passed through the electricity removal area Q5, step ST45 is repeated. If the trailing end has passed through the electricity removal area Q5, control goes to step ST46.

At step ST46, the electricity removal lamp 36 is turned off.

Next, at step ST47, whether or not the job is complete is determined. If the job is not complete, control goes to step ST42; if the job is complete, control returns to step ST41.

Experimental Example

The following experiment was carried out using the image formation system of the first example:

The intermediate transfer belt B of the four-layer structure previously described with reference to FIG. 3 was used. A red LED (light emitting diode) was installed as the electricity removal lamp 36.

A dual component developer of yellow, magenta, cyan, black of negative pole charge property was used as toner. A positive voltage of constant current control of 6 $\mu$A was applied to the primary transfer roll and the applied voltage was raised in order from the first color to the fourth color. A constant voltage of −500 V was applied to the secondary transfer roll for executing transfer.

Two types of print sample image patterns were provided. A set of solids each 2-cm square in single colors of yellow, magenta, cyan, and black, secondary color, and tertiary color and kanji characters different in size in a single color of black toner was output to the first sheet and a halftone image of 400 lines/inch in a single color of black toner was output to the second sheet. The two samples were output alternately.

Just after secondary transfer of print of the first sheet, the surface potential of the intermediate transfer belt B contained surface potential unevenness which seems to be responsive to an image pattern of about −300 V to −400 V. However, after the electricity removal lamp 36 was turned on for applying light, the surface potential of the intermediate transfer belt B became almost uniform between −10 V and −30 V, and a uniform image without inconsistencies in density or scatter was also provided as the halftone image of 400 lines/inch of the next print sample. A total of 20000 sheets of the two types of print samples were output alternately and good images without inconsistencies in density, scatter, or overweight (over thickness) were provided.

In the example, the intermediate transfer body of the four-layer structure comprising the blocking layer, the charge generation layer, and the charge transport layer formed in order on the surface of the lowest layer with carbon black dispersed was used. However, if the intermediate transfer body comprises only a single layer having photoconductivity or two layers of a photoconductive layer formed on the surface of an underlaying layer with carbon black dispersed, a similar effect can be produced and good image quality can be provided stably.

Modified Examples

As many apparently widely different examples of the invention may be made without departing from the spirit and scope thereof, it is to be understood that the invention is not limited to the example thereof except as defined in the appended claims. Modified examples of the invention are as follows:

(H01) when the resistivity change layer of the intermediate transfer body used with the invention is made of a photoconductive layer, if the surface of the intermediate transfer body B is charged to a polarity wherein electricity cannot be removed after secondary transfer, a charge brush, a charge roll, etc., for charging the surface of the intermediate transfer body B after secondary transfer to a polarity wherein electricity can be removed can be placed upstream from the electricity removal area Q5.

(H02) When the resistivity change layer of the intermediate transfer body used with the invention is made of a photoconductive layer, electricity removal voltage (DC voltage plus AC voltage) can be applied to the conductive member for electricity removal coming in contact with the rear face of the intermediate transfer body in the electricity removal area. A roll, a pad, a brush, or the like can be used as the conductive member for electricity removal.

(H03) The intermediate transfer body used with the invention can also be used with a tandem image formation system comprising a plurality of image supports.

(H04) In the image formation method and system of the invention wherein primary or second transfer of a toner image to the intermediate transfer body is executed by applying a transfer electric field in a state in which the intermediate transfer body is a dielectric (having high voltage resistivity) and electricity of the intermediate transfer body is removed in a state in which the volume resistivity of the intermediate transfer body is lowered, various intermediate transfer bodies to which a toner image can be transferred by applying a transfer electric field in a state of a dielectric having high voltage resistivity and from which electricity can be removed in a state in which the volume resistivity lowers can be used.

The image formation system of the invention can provide the following advantages:

(E01) When the transfer device for producing a transfer electric field is used to execute primary transfer and secondary transfer, transfer with toner less scattering can be executed in a state in which the volume resistivity of the intermediate transfer body is low. Since electricity can be removed in a state in which the volume resistivity of the intermediate transfer body is low, charges of the intermediate transfer body produced by the transfer electric field can be removed easily.

(E02) An intermediate transfer body having a high resistance value like that of a dielectric and having sufficiently small variations in resistance values as compared with the conventional intermediate transfer bodies can be provided. An intermediate transfer body capable of providing a good transfer toner image by suppressing change of resistance value with time can be provided. An image formation system comprising the intermediate transfer body can be provided.

(EO3) An intermediate transfer body capable of providing a color image of good quality with no toner image scattering or blurring and an image formation system comprising the intermediate transfer body can be provided.

(E04) If the resistivity change layer of the intermediate transfer body is made of a material containing a photoconductive substance, charges remaining on the intermediate transfer body after toner image transfer can be easily removed by application of light.

What is claimed is:

1. An image formation method comprising the steps of:

a latent image formation step of forming an electrostatic latent image on a surface of an image support at a latent image write position set along a turning surface of said image support;

a developing step of developing the electrostatic latent image to a toner image by a developing unit in a developing area set along the turning image support surface;

a primary transfer step, when a turning intermediate transfer body having a resistivity change layer whose volume resistivity lowers with predetermined physical stimulation given passes through a primary transfer area set along the turning image support surface, said primary transfer step of producing a primary transfer electric field between said intermediate transfer body and the image support surface by a primary transfer device placed facing said image support with the primary transfer area between and primarily transferring the toner image on the image support surface to said intermediate transfer body;

a secondary transfer stop, when a transfer material transported by a transfer material transporter passes through a secondary transfer area set along a turn passage of said intermediate transfer body, said secondary transfer step of producing a secondary transfer electric field by a secondary transfer device placed facing said intermediate transfer body passing through the secondary transfer area with the transfer material between and secondarily transferring the toner image on said intermediate transfer body surface to the transfer material; and an electricity removal step, when said intermediate transfer body where the secondary transfer step has been executed passes through an electricity removal area set downstream from the secondary transfer area of the turn passage of said intermediate transfer body and upstream from the primary transfer area, the electricity removal area wherein a conductive member for electricity removal for coming in contact with said intermediate transfer body and supplying charges for electricity removal and a stimulation giving member for giving predetermined physical stimulation to said intermediate transfer body coming in contact with said conductive member are placed, the electricity removal step of giving physical stimulation to said intermediate transfer body and removing electricity of said intermediate transfer body in a state in which volume resistivity of said resistivity change layer of said intermediate transfer body is lowered.

2. The image formation method as claimed in claim 1, wherein the predetermined physical stimulation is light application, and said intermediate transfer body has the resistivity change layer which is a dielectric having high volume resistivity in a state in which light is not applied, and becomes a photoconductive layer having low volume resistivity in a state in which light is applied; and a stimulation giving member for applying the physical stimulation is made of an electricity removal lamp.

3. An image formation system comprising:

an image support on which an electrostatic latent image is formed at a latent image write position set along a turning surface of said image support;

a developing unit for developing the electrostatic latent image to a toner image in a developing area set along the image support surface;

an intermediate transfer body turning through a primary transfer area set along the image support surface and passing through a secondary transfer area set along a turn passage;

a primary transfer device being placed facing said image support with said intermediate transfer body between in the primary transfer area for applying a primary transfer voltage to nip between said intermediate transfer body and said image support for transferring the toner image on the image support surface to said intermediate transfer body;

a transfer material transporter for transporting a transfer material to the secondary transfer area and allowing the transfer material to pass through the secondary transfer area;

a secondary transfer device for applying a secondary transfer voltage to nip between said intermediate transfer body and the transfer material in the secondary transfer area so as to transfer the toner image on said intermediate transfer body to the transfer material;

a conductive member for electricity removal for coming in contact with said intermediate transfer body and supplying charges for electricity removal in an electricity removal area set downstream from the secondary transfer area of the turn passage of said intermediate transfer body and upstream from the primary transfer area;

said intermediate transfer body having a resistivity change layer whose volume resistivity lowers when predetermined physical stimulation is given;

a stimulation giving member for giving the predetermined physical stimulation to said intermediate transfer body in the electricity removal area; and a resistivity controller for giving physical stimulation to the resistivity change layer by said stimulation giving member and lowering the volume resistivity of the resistivity change layer, when said intermediate transfer body where secondary transfer has been executed in the secondary transfer area passes through the electricity removal area.

4. The image formation system as claimed in claim 3, wherein said conductive member for electricity removal is grounded.

5. The image formation system am claimed in claim 3, wherein to give the physical stimulation is to apply light and said intermediate transfer body has the resistivity change layer whose resistance value changes as light is applied, and whose volume resistivity lowers in a state in which light is applied;

said stimulation giving member is made of an electricity removal lamp for applying electricity removal light to said intermediate transfer body in the electricity removal area; and said resistivity controller has a light source control circuit for turning on the electricity removal lamp, when said intermediate transfer body where secondary transfer has been executed in the secondary transfer area possess through the electricity removal area so as to apply light to the resistivity change layer for lowering the volume resistivity of the resistivity change layer.

6. The image formation system as claimed in claim 5, wherein said intermediate transfer body has the resistivity change layer which is a dielectric having high volume resistivity in a state in which light is not applied, and becomes a photoconductive layer having volume resistivity lowering in a state in which light is applied.

7. The image formation system as claimed in claim 6, wherein the resistivity change layer is a dielectric having volume resistivity ρ calculated according to the following expression (1) satisfying the following expression (2):

$$\rho = RS/L \quad (1)$$

$$\rho > 10^{14}\ \Omega\text{cm} \quad (2)$$

wherein R is a measurement resistance value between the surface and rear face of the resistivity change layer in a state in which light is not applied, L is the distance between the surface and rear face, and S is the area of the measurement portion.

8. The image formation system as claimed in claim 6, wherein said intermediate transfer body comprises:

the resistivity change layer having a charge transport layer for transporting charges by carriers of either negative-polarity electrons or positive-polarity holes in a state in which light is applied, a charge generation layer being disposed on the rear face of the charge transport layer for generating charges in a state in which light is applied, and a blocking layer being disposed on the rear face of the charge generation layer for allowing carriers of the opposite polarity to the carriers of the charge transport layer to move and inhibiting move of carriers of the same polarity as the carriers of the charge transport layer.

9. The image formation system as claimed in claim 8, wherein said intermediate transfer body has a semiconductive sheet-like base material having mechanical strength being disposed on the rear face of the blocking layer.

10. The image formation system as claimed in claim 3 wherein to give the predetermined physical stimulation is to apply pressure and the intermediate transfer body has a resistivity change layer whose volume resistivity changes as pressure is applied, and lowers in a state in which pressure is applied;

said stimulation giving member is made of a pressure application member supported for move between a press position where said pressure application member is pressed toward said conductive member for electricity removal from the surface of said intermediate transfer body in the electricity removal area and a distant position where said pressure application member is away from the surface of said intermediate transfer body; and said resistivity controller is made of a pressure application member move controller for holding the pressure application member at the press position when said intermediate transfer body where secondary transfer has been executed in the secondary transfer area passes through the electricity removal area, thereby applying pressure to the resistivity change layer for lowering the volume resistivity of the resistivity change layer.

11. An intermediate transfer body comprising:

a resistivity change layer made of a photoconductive layer which is a dielectric layer having high volume resistivity in a state in which light is not applied, and has a charge transport layer for transporting charges by carriers of either negative-polarity electrons or positive-polarity holes in a state in which light is applied, a charge generation layer being disposed on the rear face of the charge transport layer for generating charges in a state in which light is applied, and a blocking layer being disposed on the rear face of the charge generation layer for transporting charges by carriers of the opposite polarity to the carriers of the charge transport layer and suppressing transport of charges by carriers of the same polarity as the carriers of the charge transport layer.

12. The intermediate transfer body as claimed in claim 11, wherein the resistivity change layer in a dielectric having volume resistivity ρ calculated according to the following expression (1) satisfying the following expression (2):

$$\rho = RS/L \quad (1)$$

$$\rho > 10^{14}\ \Omega\text{cm} \quad (2)$$

wherein R is a measurement resistance value between the surface and rear face of the resistivity change layer in a state in which light is not applied, L is the distance between the surface and rear face, and S is the area of the measurement portion.

13. The intermediate transfer body as claimed in claim 11, further comprising:

a semiconductive sheet-like base material having mechanical strength being disposed on the rear face of the blocking layer.

14. The intermediate transfer body as claimed in claim 13, wherein the sheet-like base material has volume resistivity ranging from $10^6$ to $10^{13}$ Ωcm.

15. An image formation method, comprising the steps of:

primarily transferring a toner image held on an image support to an intermediate transfer body by a primary transfer device, secondarily transferring the toner image from said intermediate transfer body to a transfer material by a secondary transfer body, after the step of secondarily transferring the toner image is executed, physical stimulation is applied to said intermediate transfer body by electrical contact with an electricity removal member placed downstream from said secondary transfer body to lower the volume resistivity thereof, and forming an image, wherein said intermediate transfer body has a resistivity lowering layer whose volume resistivity lowers in a state in which a predetermined physical stimulation is applied.

16. An image formation system comprising:

an image support on which an electrostatic latent image is formed;

a developing unit for developing the electrostatic latent image formed on said image support to a toner image on said image support;

an intermediate transfer body for temporarily holding the toner image, said intermediate transfer body having volume resistivity lowering in a state in which predetermined physical stimulation is given;

a primary transfer device for primarily transferring the toner image formed by said developing unit to said intermediate transfer body;

a secondary transfer device for secondarily transferring the toner image held on said intermediate transfer body to a transfer material;

a physical stimulation giving member being placed downstream from said secondary transfer device for given physical stimulation to said intermediate transfer body where the secondary transfer has been executed for lowering the volume resistivity of said intermediate transfer body; and an electricity removal member being placed downstream from said secondary transfer device for coming in electric contact with said intermediate transfer body having the volume resistivity lowering as a result of giving the physical stimulation to said intermediate transfer body.

17. The image formation system as claimed in claim 16, wherein said physical stimulation giving member is light application means for applying light.

18. The image formation system as claimed in claim 16, wherein said intermediate transfer body is a dielectric having high volume resistivity in a state in which light is not applied, and is a conductor having low volume resistivity in a state in which light is applied.

19. The image formation system as claimed in claim 16, wherein said intermediate transfer body has volume resistivity of $10^{14}$ Ωcm or more.

20. The image formation system as claimed in claim 16, wherein said intermediate transfer body comprises:

a charge transport layer for transporting charges by carriers of negative-polarity or positive-polarity, a charge generation layer for generating charges in a state in which light is applied, and a blocking layer for allowing carriers of the opposite polarity to the carriers of said charge transport layer to move and inhibiting move of carriers of the same polarity as the carriers of said charge transport layer.

21. The image formation system as claimed in claim 16, wherein when the surface potential of said intermediate transfer body after the secondary transfer is of negative polarity, said charge transport layer transports charges by carriers of positive polarity and said blocking layer inhibits move of carriers of positive polarity and allows carriers of negative polarity to move.

22. The image formation system as claimed in claim 16, wherein when the surface potential of said intermediate transfer body after the secondary transfer is of positive polarity, said charge transport layer transports charges by carriers of negative polarity, and said blocking layer inhibits move of carriers of negative polarity and allows carriers of positive polarity to move.

* * * * *